US011433509B2

(12) United States Patent
Rotem et al.

(10) Patent No.: US 11,433,509 B2
(45) Date of Patent: Sep. 6, 2022

(54) EXTENSION CONTROL HANDLE FOR A PORTABLE GRIP DEVICE

(71) Applicant: Nemo Power Tools, Ltd., Hong Kong (HK)

(72) Inventors: Nimrod Rotem, Hong Kong (HK); Darren Stoler, Queensland (AU); Guo Fei, Guangdong (CN); Eduard Tsfasman, Sha'ar Efraim (IL); Oleg Joukov, Sha'ar Efraim (IL)

(73) Assignee: Nemo Power Tools, Ltd., Hong Kong (HK)

( * ) Notice: Subject to any disclaimer, the term of this patent is extended or adjusted under 35 U.S.C. 154(b) by 0 days.

(21) Appl. No.: 17/334,668

(22) Filed: May 28, 2021

(65) Prior Publication Data

US 2021/0299825 A1 Sep. 30, 2021

Related U.S. Application Data

(63) Continuation-in-part of application No. 16/769,107, filed as application No. PCT/IL2019/050502 on May 5, 2019.

(30) Foreign Application Priority Data

May 8, 2018 (IL) ..... 259216

(51) Int. Cl.
*B25B 11/00* (2006.01)
*B25G 1/10* (2006.01)

(52) U.S. Cl.
CPC ..... *B25B 11/007* (2013.01); *B25G 1/102* (2013.01)

(58) Field of Classification Search
CPC ... Y10T 16/469; Y10T 16/476; Y10T 16/498; Y10T 16/4713; Y10T 16/4719;
(Continued)

(56) References Cited

U.S. PATENT DOCUMENTS 1,036,586 A 8/1912 Dove
2,920,916 A 1/1960 Pagdin
(Continued)

FOREIGN PATENT DOCUMENTS

BE 1001645 A6 1/1990
CN 201147927 Y 11/2008
(Continued)

*Primary Examiner* — Tyrone V Hall, Jr.
(74) *Attorney, Agent, or Firm* — KandareIP, LLC; Anthony Kandare

(57) ABSTRACT

A detachable control handle for an extended grip system is provided for attachment with an interface of a portable grip device including a pair of spaced apart connector tabs extending from a rigid frame of the portable grip device and forming a pair of parallel captivation channels. The control handle can include an elongate grip handle and a pair of opposed support arms attached to the grip handle and extending away at angles from each other. The support arms can be more flexible in a perpendicular direction of the portable grip device. A crossarm can extend between the pair of support arms proximate a second end portion for establishing a preset inboard spacing maintaining the pins and support arms in an after-attached arrangement that can interfere with connecting and disconnecting. A method includes a user flexing the engagement members and pins for guiding the attachment.

16 Claims, 25 Drawing Sheets

FIGURE 18

(58) Field of Classification Search
CPC .. B65G 49/061; B65G 2249/045; B25G 3/02; B25G 3/04; B25G 3/10; B25G 3/24; B25G 1/102; B25B 11/005; B25B 11/007
See application file for complete search history.

(56) References Cited

U.S. PATENT DOCUMENTS

| | | | | | |
|---|---|---|---|---|---|
| 3,181,027 | A | | 4/1965 | Geer | |
| 3,506,297 | A | | 4/1970 | Creskoff | |
| 3,724,659 | A | | 4/1973 | Buhrer | |
| 3,915,241 | A | | 10/1975 | Bieri | |
| 4,434,808 | A | * | 3/1984 | Burak | A61H 3/0288 135/70 |
| 4,852,926 | A | | 8/1989 | Littell | |
| 5,154,096 | A | * | 10/1992 | Geller | B62H 7/00 74/551.8 |
| 5,507,071 | A | * | 4/1996 | Berfield | A47L 9/32 16/406 |
| 5,795,001 | A | | 8/1998 | Burke | |
| 5,850,667 | A | * | 12/1998 | Orsini | A47L 9/32 15/350 |
| 6,244,778 | B1 | | 6/2001 | Chesbrough | |
| 6,279,976 | B1 | | 8/2001 | Ball | |
| 6,296,426 | B1 | | 10/2001 | King et al. | |
| 6,341,808 | B1 | | 1/2002 | Baan et al. | |
| 6,413,022 | B1 | | 7/2002 | Sarh | |
| 6,502,877 | B2 | | 1/2003 | Schick et al. | |
| 7,216,403 | B2 | | 5/2007 | Decker | |
| 7,222,901 | B2 | | 5/2007 | Gebauer et al. | |
| 7,267,512 | B1 | | 9/2007 | Mueller | |
| 7,404,536 | B2 | | 7/2008 | Kalb | |
| 7,712,807 | B2 | | 5/2010 | Perlman et al. | |
| 7,963,578 | B2 | | 6/2011 | Wells et al. | |
| 8,096,537 | B2 | | 1/2012 | Browne et al. | |
| 9,108,319 | B2 | | 8/2015 | Kniss et al. | |
| 9,215,962 | B2 | | 12/2015 | Qian | |

FOREIGN PATENT DOCUMENTS

| | | | | | |
|---|---|---|---|---|---|
| CN | 205555846 | U | | 9/2016 | |
| DE | 3724659 | A1 | | 2/1989 | |
| EP | 3181027 | A1 | | 6/2017 | |
| FR | 1036586 | A | | 9/1953 | |
| GB | 451455 | A | * | 8/1936 | A47L 9/325 |
| GB | 1036586 | A | | 7/1966 | |
| WO | 2001021357 | A1 | | 3/2001 | |
| WO | 2010110719 | A1 | | 9/2010 | |
| WO | 2017215163 | A1 | | 12/2017 | |

* cited by examiner

PRIOR ART

0

20

FIGURE 13A
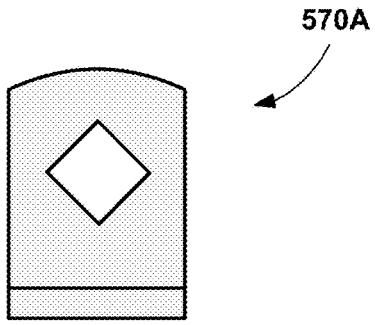
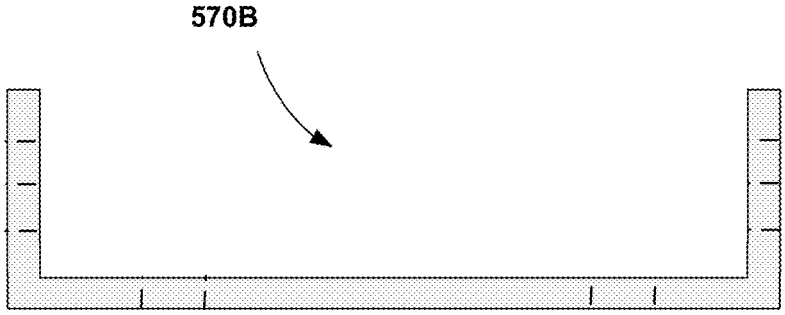
FIGURE 13B
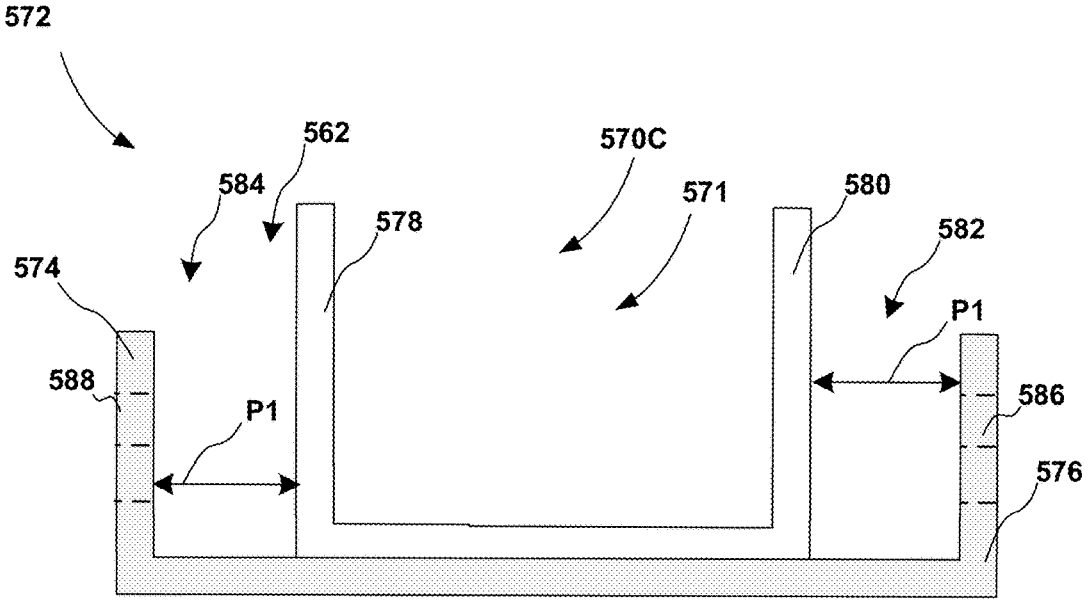
FIGURE 13C

EXTENSION CONTROL HANDLE FOR A PORTABLE GRIP DEVICE

CROSS-REFERENCE TO RELATED APPLICATIONS

This application is a Continuation-in-Part of co-pending U.S. patent application Ser. No. 16/769,107 filed Jun. 2, 2020; which is National Stage entry of International patent application No. PCT/IL2019/050502 filed on May 5, 2019; which claims priority to foreign Israeli patent application no. 259216 filed on May 8, 2018; the entire contents of each of which are incorporated herein by reference.

BACKGROUND

Aspects, features, and concepts described herein relate to material handling tools, devices systems and methods, and more particularly to gripping devices. More particularly, the subject matter described herein relates to grippers for gripping object surfaces and, in particular, to vacuum grippers. Further, the present disclosure relates to portable, high-grip maneuverable grippers and related ergonomic control mechanisms.

Handheld or portable vacuum material handling or gripping devices are known and increasingly being used in industry and home use for gripping, handling, and moving wide ranges and types of objects. Conventional vacuum-based gripping devices historically relied upon suction-cup based arrangements and designs, which is still the case for many portable and handheld type gripping devices as well as various industrial implementations. As an example, FIG. 1 shows several views of a handheld, battery powered vacuum device for handling articles, which is shown and further described in U.S. Pat. No. 5,795,001 filed Dec. 18, 1996. As discussed in the '001 patent, early versions of portable vacuum devices suffered drawbacks related to low power and loss of suction during use, for which the '001 patent provided improvements. Portable and handheld vacuum devices can provide advantages related to portability and maneuverability, as well as expanding their applications and use along, with continuing improvements for gripping strength and lift reliability.

Even though development and usage of portable vacuum gripper devices has greatly increased in recent years and become more commonplace, such portable gripper devices remain operable by the user as a handheld device or power tool. Significant improvements for lifting strength and usage have occurred in recent years, which have expanded their usage for a wide range of applications that can be challenging to perform using handheld devices and control interfaces. For example, ranges of object weights that can be lifted using such devices have greatly increased over recent years, which can be challenging for a user to manage, lift or handle using a handheld grip device even if within operation limits for the device. In addition, the use of a handheld device or interface can pose significant health risks including enhanced back injury risks. This can often be the case when using a portable vacuum grip device to move many heavy, flat objects, such as tiles.

Such needs and desires for improved options are well-know, have existed for many years, and are understood throughout the world. For example, Belgium patent ref. no. BE1001645 filed Aug. 2, 1989 describes Dutch and Belgian lifting tool improvements including a plunger-based vacuum gripping tool configured for gripping flat objects such as tiles. The '645 patent describes a vacuum based lifting tool having a couple different implementations, which included a central handle enabling one or more users to lift the heavy tile without bending over and risking back injuries. However, the proposed improvements were ineffective and cumbersome for lifting heavy weights, such as tiles.

Various other solutions and proposals have been provided for reducing back injury concerns related'to lifting objects, as well as for performing a variety of tasks. For example, FIGS. 3A & 3B show proposals described in U.S. Pat. No. 7,216,403 filed Aug. 27, 2004 for adding extension handles to vacuum cleaners or similar floor type appliances for avoiding back injuries and other related injuries and concerns related with lifting heavy objects, and repetitive bending or lifting actions for moving or lifting light to medium weight objects. Portable vacuum-based grip devices and technologies have significantly improved in recent years and continue to provide significant benefits pertaining to their maneuverability and portability, as well as enhanced strength and lifting abilities.

Thus, a need exists for overcoming drawbacks and limitations of conventional portable lifting devices and systems including reducing risks for back injuries and related injuries for bending over and lifting heavy objects while maintaining benefits and advantages provided by portable, easily maneuverable portable grip devices and systems.

SUMMARY

This summary introduces certain aspects of the embodiments described herein to provide a basic understanding. This summary is not an extensive overview of the inventive subject matter, and it is not intended to identify key or critical elements or to delineate the scope of the inventive subject matter.

According to aspects and features of inventive subject matter described herein, a detachable control handle or control handle extension is provided for quick and secure attachment with an interface of a portable grip device. In one example arrangement according to aspects and features described herein, a detachable control handle of an extended lift system is configured for secure attachment with an interface of a portable grip device having a primary axis, in which the interface includes a pair of spaced apart opposing connector tabs oriented parallel with the primary axis and can extend from a rigid frame of the portable grip device. Each of the connector tabs of the pair can have an offset retention surface on an inboard side that forms a parallel captivation channel having a channel width, P1, in a direction perpendicular to the primary axis. Further, each connector tab can define a connection opening extending between the inboard and outboard side of the connector tab. As such, the interface of the portable grip device is configured to form a captive connector attachment with a detachable control handle or detachable control extension.

The detachable control handle cap include an elongate grip handle oriented parallel with the primary axis when attached to the portable grip device, and a pair of opposed support arms that each have a first end portion connected to the elongate grip handle at opposite side portions of the handle. The pair of opposed support arms are oriented apart from each other extending from the first end portion of the support arms to an opposite second end portion and are oriented parallel with the primary axis. Further, each support arm has greater strength and stiffness parallel with the primary axis and greater flexibility perpendicular to the primary axis. A pair of engagement members are attached to the support arms including one engagement member of the pair attached to each of the second end portions, for which the engagement members are oriented parallel with the primary axis.

The detachable control handle further includes a pair of opposing connector pins having a pin length, P2, that is less than the channel width, P1, of the captivity channels defined for the interface. Each pin of the pair of pins partially extending through one of the engagement members attached to a second end portion of one of the pair of support arms and oriented perpendicular to the primary axis. In addition, the detachable control handle includes a crossarm extending between the pair of support arms in a direction perpendicular to the primary axis, in which the crossarm establishes a preset inboard spacing between the pair of support arms at a crossarm interface proximate the second end portions of the pair of support arms and for the pair of opposing pins and the pair of engagement members. As such, the pair of opposed engagement members and the pair of pins have a connection arrangement matching an after-attachment arrangement with the interface of the portable grip device interface, which when detached from the portable grip device the matching arrangement can create interference for connecting to the portable grip device.

Further, the pair of engagement members are configured to flex inboard in a direction normal to the primary axis when manually flexed for overcoming the interference and enabling connection of the pair of opposing pins with the corresponding tab connectors while maintaining the matching arrangement, The detachable control handle is also configured to exert outboard retention forces to the pair of opposing connector pins when attached to the portable grip device under load conditions, such that the detachable control handle is configured to establish a secure captive connection attachment with the portable grip device.

According to other aspects, features and concepts described herein, a method for providing ergonomic vertical support for lifting actions using, a portable grip device is provided. Based on the method, attaching a detachable control handle to a portable grip device can include aligning a pair of engagement members and a pair of pins of the detachable control handle with a captivation channel of a portable grip device, and advancing the pair of engagement members and the pair of pins to begin entry into the captivation channels. The method can further include a user manually flexing each of the engagement members inboard while continuing to advance the pair of engagement members fully into the captivation channel. In addition, the method can include discontinuing the manual flexing of the engagement members, and attempting to withdraw the engagement members from the corresponding captivation channels. Attempting to withdraw the engagement members can permit the pair of engagement members and the pair of pins to complete connection with the portable grip device in the absence of manual flex and while within the captivation channels. The method can additionally include applying an increasing load to the combination for confirming the attachment arrangement and fully establishing the captive connection attachment.

Other portable grip device related subject matter and extended control handle connections for portable grip device related technologies, related systems, and components, and/or methods according to embodiments will be or become apparent to one with skill in the art upon review of the following drawings and detailed description. It is intended that all such additional devices, related components, systems, and/or methods included within this description be within the scope of this disclosure.

BRIEF DESCRIPTION OF THE DRAWINGS

FIGS. 13A to 13C are plan views of optional interface devices for use with a portable grip device.

DETAILED DESCRIPTION

Figure 1:
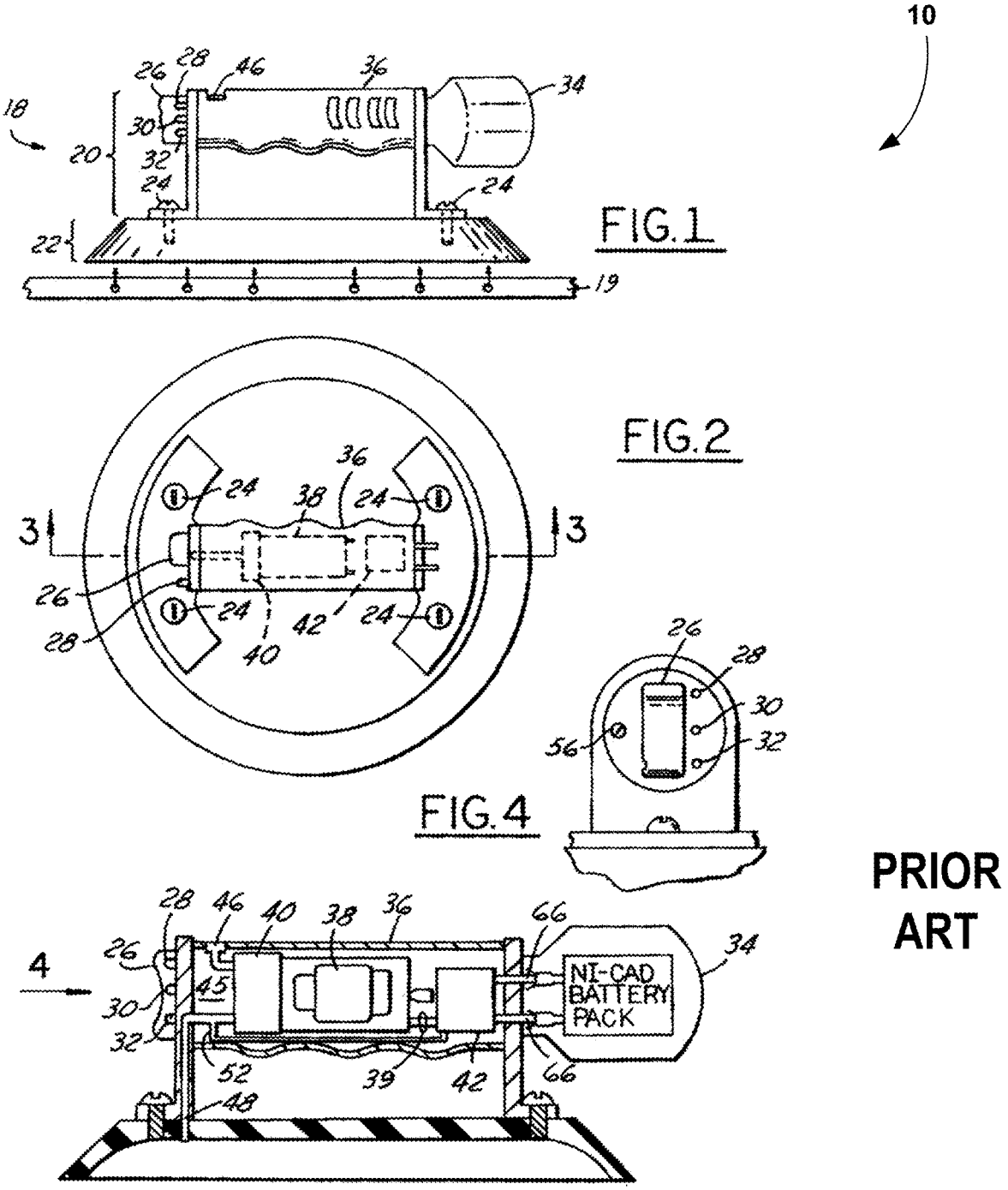
FIG. 1 shows a PRIOR ART portable vacuum device having a conventional suction cup style gripper arrangement as described in U.S. Pat. No. 5,795,001 filed Dec. 18, 1996.
Figure 2:
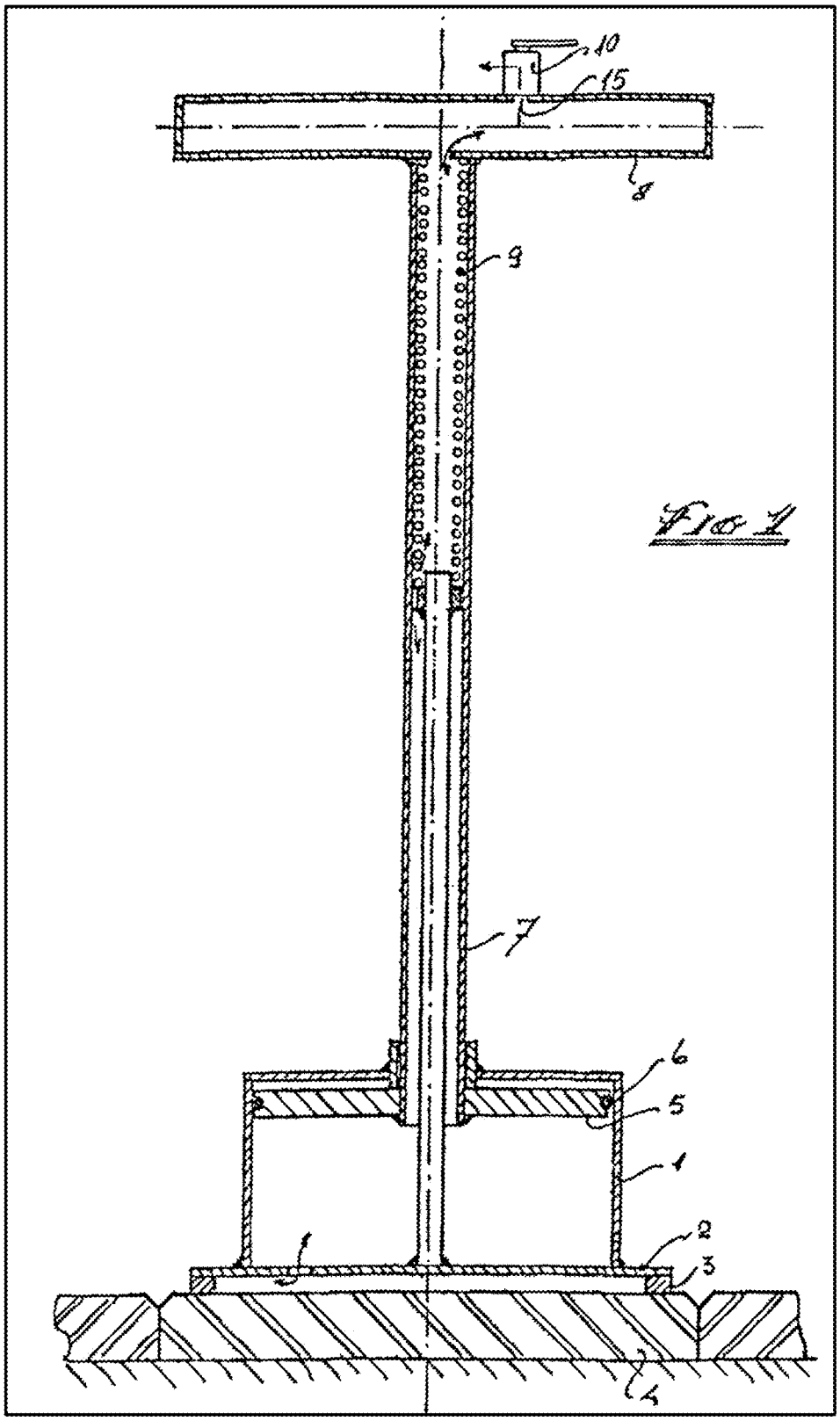
PRIOR ART FIGURE 2
FIG. 2 shows a PRIOR ART gripping tool having an extended handle for enabling use of the device as hand tool for grabbing tiles while maintaining a straight back orientation as described in Belgian patent application no. BE1001645 filed Aug. 2, 1989.
Figure 3A:
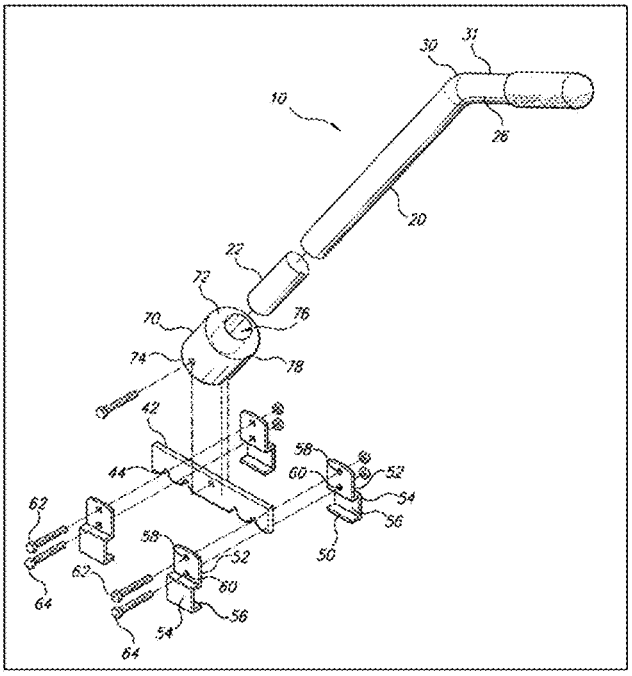
FIGS. 3A & 3B show a PRIOR ART ergonomic appliance handle for attachment to a canister style vacuum cleaner or similar floor appliance as an extension handle as described in U.S. Pat. No. 7,216,403 filed Aug. 27, 2004.
Figure 3B:
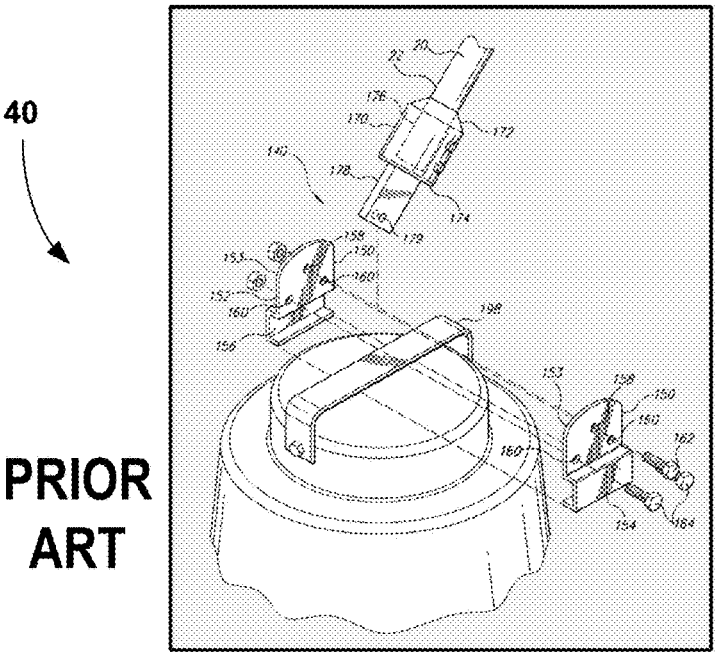
Figure 4:
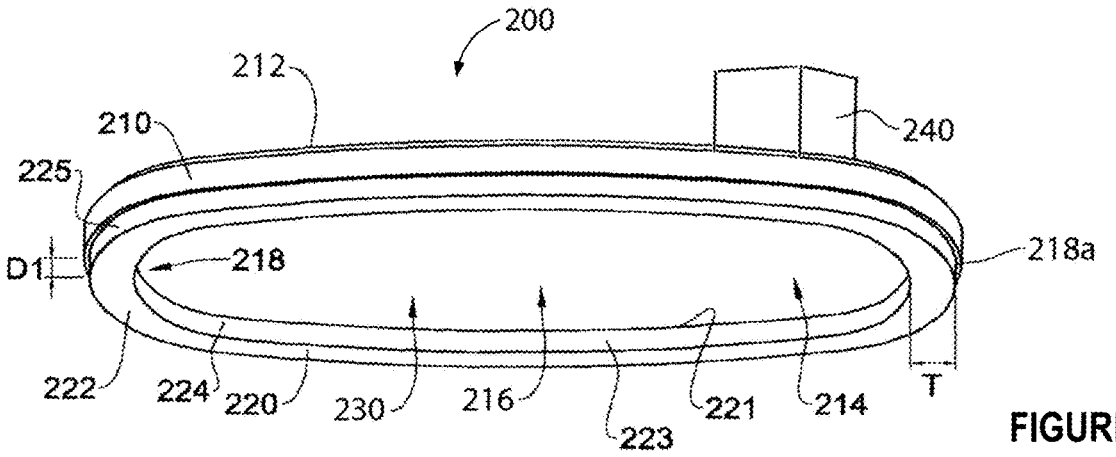
FIGS. 4-6 show bottom perspective views of an example vacuum gripper pertaining to aspects, features and concepts discussed herein.

For the purposes of promoting an understanding of the aspects, features and principles pertaining to the invention and configurations discussed herein, reference will now be made to the example configurations and arrangements illustrated in the drawings along with language describing the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments can be combined in whole or in part one with another as the claims and/or art may direct, either directly or indirectly, implicitly, or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

As used herein, the term "about" when used in connection with a referenced numeric indication means the referenced numeric indication plus or minus up to 10 percent of that referenced numeric indication. For example, the language "about 50" covers the range of 45 to 55. Similarly, the language "about 5" covers the range of 4.5 to 5.5.

As used in this specification and the appended claims, the words "top," "above," and "upward" refer to elevation directions away from the ground level of an exercise device in its typical or intended usage orientation at or towards a higher elevation, and the words "bottom," "below," "base" and "downward" refer to elevation directions at or towards the ground level of an exercise device at a lower elevation in its typical usage orientation. Thus, for example, the top of a control handle attached to a portable vacuum grip device that is farthest from the ground level of the grip device gripping a tile to be carried would be the vertical distal end of the combined structure, and the end opposite the vertical distal end (i.e., the base of the grip device interfacing with the tile surface) would be the base or bottom of the combination.

Further, specific words chosen to describe one or more embodiments and optional elements, or features are not intended to limit the invention. For example, spatially relative terms—such as "beneath," "below," "lower," "above," "upper," "proximal," "distal," and the like—may be used to describe the relationship of one element or feature to another element or feature as illustrated in the figures. These spatially relative terms are intended to encompass different positions (i.e., translational placements) and orientations (i.e., rotational placements) of a device in use or operation in addition to the position and orientation shown in the figures. For example, if a device in the figures were turned over, elements described as "below", or "beneath" other elements or features would then be "above" or "over" the other elements or features. Thus, the term "below" can encompass both positions and orientations of above and below. A device may be otherwise oriented (e.g., rotated 90 degrees or at other orientations) and the spatially relative descriptors used herein interpreted accordingly. Likewise, descriptions of movement along (translation) and around (rotation) various axes include various spatial device positions and orientations.

Similarly, geometric terms, such as "parallel," "perpendicular," "round," "curvilinear," "articulated" or "square," are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

In addition, the singular forms "a," "an," and "the" are intended to include the plural forms as well, unless the context indicates otherwise. The terms "comprises," "includes," "has," and the like specify the presence of stated features, steps, operations, elements, components, etc., but do not preclude the presence or addition of one or more other features, steps, operations, elements, components, or groups.

Unless indicated otherwise, the terms exercise apparatus, device, equipment, systems, and variants thereof, can be interchangeably used.

In this specification, the applicant may refer to an existing device including a gripper, a grip device, an electric tool, a power tool, a portable tool, a gripping device, grabber device or a grabber. The reader shall note that the distinction is that an existing device for use with aspects and features of a control handle described herein may be already designed prior to consideration for use with a control handle and existing portable electric gripping devices may be on the market. The reader shall interpret minor modifications of the grip device or existing gripper or power tool for attachment and use with a control handle as still part of the combination with the control handle and still within the spirit of the scope of the subject matter disclosed.

As used herein, a "readily-attachable" or "quick-connect" control handle refers to a control handle configured for quick and secure attachment without the use of tools with corresponding interface connectors of a portable electric tool or grip device for maneuvering and otherwise controlling the attached device using the control handle.

Portable Grip Device

In accordance with a general aspect of concepts discussed herein, a portable grip device is provided, which can be a device suitable for gripping an object at an object surface due to a vacuum which is created between the vacuum gripper and the object surface.

Figure 7:
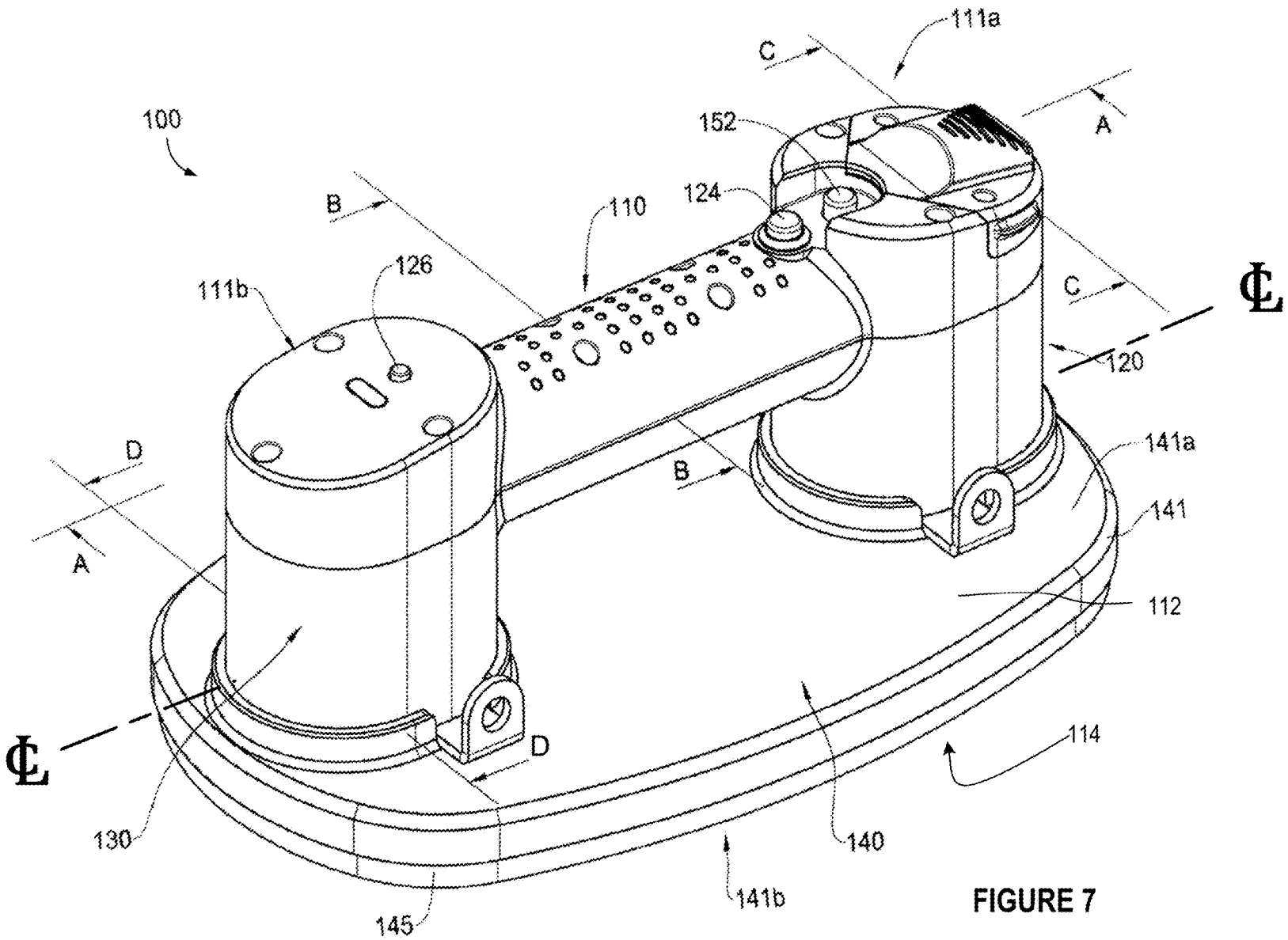
FIG. 7 is a perspective view of an example portable grip device having interface features that can allow for attachment of an example ergonomic control handle according to aspects and features described herein.

According to one example, as schematically shown in FIG. 7, a vacuum gripper 100 that can include a rigid base element 110 having a first side 112 and a second side 114 opposite to the first side 112. The second side 114 has a central area 116 and a periphery 118 surrounding the central area 116. The periphery 118, which is seen only partially, is bounded by a peripheral rim 118 a radially spaced thereby from the central area.

The vacuum gripper 100 can further include a loop-shaped vacuum seal element 120 attached with an attachment surface 121 thereof to the periphery 118 along a peripheral support area 118*b* (not seen). The loop-shaped vacuum seal element 120 can further include a protruding portion 123 which is free of contact with the base element 110 and which protrudes from the second side 114 of the base element 110 in a direction away from the first side 112 of the base element 110 to a predetermined distance D1.

The protruding portion 123 of the vacuum seal element 120 can include a contact surface 122 configured to be brought into at least a partial contact with an object surface. The vacuum seal element 120 also can include an inner encircling surface 124 oriented transversely to and extending from the contact surface 122 and facing towards the central area 116 to define therewith a chamber 130 along the protruding portion 123. The vacuum seal element 120 also can include an outer encircling surface 125 oriented transversely to and extending from the contact surface 122 and facing away from the central area 116 and the chamber 130, and the peripheral rim 118*a* of the second side of the base element protruding outwardly from the outer encircling surface.

Thus, the contact surface 122 and the attachment surface 121 of the vacuum seal element both extend between the inner and outer encircling surfaces 124 and 125. As can be understood from FIG. 5, in this example the contact surface 122 is co-extensive with the attachment surface 121 along the periphery of the second side of the base element.

Figure 5:
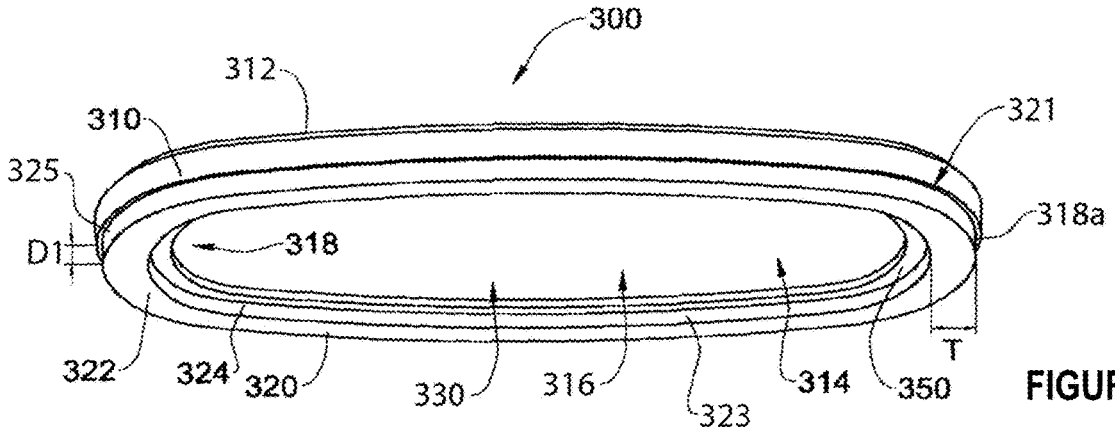

As further seen in FIG. 5, the predetermined distance D, to which the protruding portion 123 protrudes from the second side of the rigid base element, can be configured not to exceed a thickness T of the protruding portion between the inner and outer encircling surfaces. More particularly, the thickness T of the protruding portion can be greater than the predetermined distance D1.

The vacuum seal element 120 is elastically deformable at least at its contact surface 122 to enable the contact surface 122 to conform to an object surface when pressed thereagainst. The vacuum gripper 100 can further include an air extraction means 140 mounted to the first side 112 of the base element 110 to be in fluid communication with the chamber 130 through the base element 110. The air extraction means 140 is configured to continuously extract air from the chamber to cause the contact surface 122 to be urged towards and thereby grip an object surface when pressed thereagainst.

Figure 8:
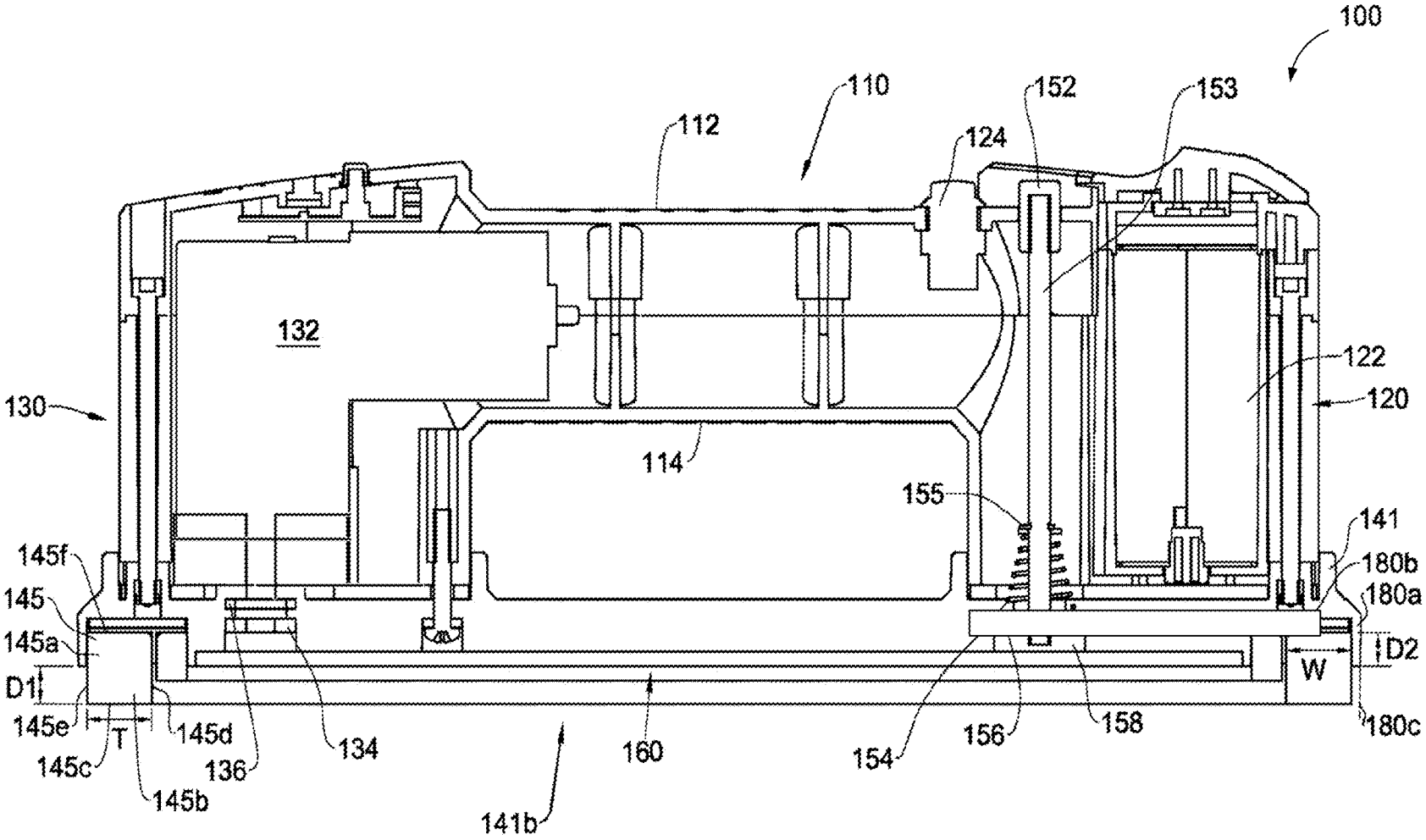
FIG. 8 is cross-sectional side view of the example portion grip device of FIG. 7.

The vacuum gripper 100 can include a handle portion 110, a power supply portion 120, a pump portion 130 and a base portion 140. The handle portion 110 has a first end 111*a* and a second end 111*b*, by which the handle portion 110 is connected or mounted to the base portion 140. The base portion 140 as seen in FIG. 8 can include a rigid base element 141 having a first side 141*a* and a second side 141*b* opposite to the first side, and a vacuum seal element 145 held thereby.

The first side of 141*a* of the base element 141 is the same as a first side 140*a* of the base portion 140. The handle portion, power supply portion and pump portion are disposed on the first side 141*a* of the rigid base element 141, and can be mounted thereto either directly or via each other. For example, the power supply portion and the pump portion can be mounted to the first side 141*a* of the base element 141 via the handle portion 110. Such mounting avoids disconnection of components due to any vibrations caused when a pump of the pump portion is in operation.

Handle portion 110 can be a single piece or can comprise multiple pieces. If the handle portion can include multiple pieces, it can be hollow and so it can be possible to house various components within the handle. Such housings can be joined by screws, bolts, adhesives, or snap-fitting arrangements, for example.

The handle can be connected along a single surface or at multiple surfaces to the base portion. The handle can have a wider palm-gripping portion and a narrower finger-gripping portion to allow easy grasping of the handle. Alternatively, the handle can comprise a hole or aperture when connected to the base portion, to allow a hand to grasp around the handle easily. The handle can take an elongate shape for easy grasping. For ease of grasping, the handle can be provided with textured surfaces, in the form of protrusions and/or recesses, for improved friction with a user's hand.

Figure 6:
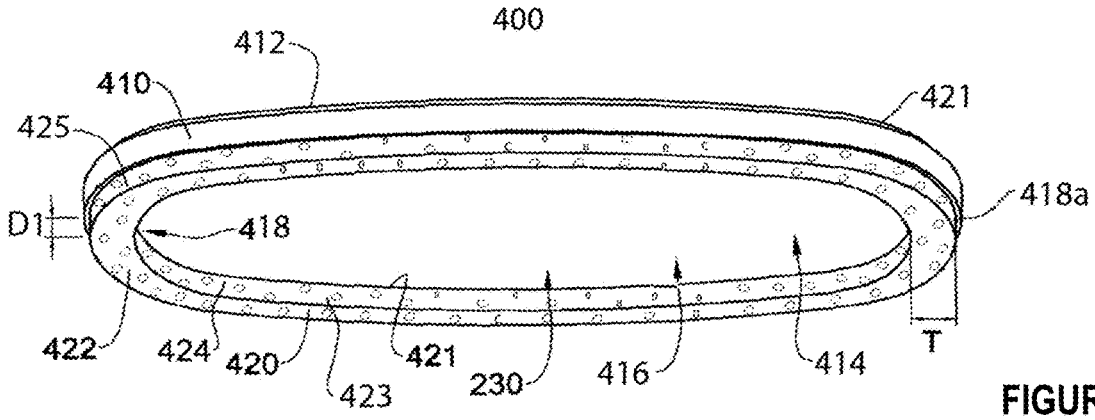

As shown specifically in the vacuum gripper 100, as seen in FIG. 8 the handle portion 110 can include an upper housing 112 and a lower housing 114, which are joined together by at least one screw or bolt 116. The upper and lower housings 112, 114 are arranged in this example to form an elongate shape, easily capable of being gripped by a user's hand. In order to provide improved grip in the hand of user, the surface of the upper and lower housings 112, 114 are provided with multiple recesses 118 (see FIG. 6) arranged in rows and columns.

The power supply portion and the pump portion can be provided separately from the handle portion or can be provided within the handle portion. For example, arrangements are envisioned, whereby the power supply portion and the pump portion are arranged at the same or opposite ends of the handle portion, or one or both are not at either end but rather in the middle of the handle portion. Alternatively, one or both power supply portion and the pump portion can be provided within an end of the handle portion, and extending further into the handle portion away from that end.

In the vacuum gripper as shown in FIG. 7, the power supply portion 120 is arranged at and within the first end 111*a* of the handle portion 110 and the pump portion 130 is arranged within the second end 111*b* of the handle portion 110, which is the opposite end of the handle portion 110 front the first end 111*a*. The pump portion 130 extends further from the second end 111*b* into the handle portion 110.

The power supply portion is for supplying power to the pump portion, and can be a battery pack. The power supply portion can be electrically connected to the pump portion through the handle, or outside of the handle, for example, along the first surface of the base portion to which the handle is mounted. In the former case, the electrical connection has greater structural integrity as it can be protected from environmental damage.

As shown in more detail in FIGS. 7 and 8, the power supply portion 120 can include a battery or battery pack 122, arranged to supply power to the pump portion 130 of the vacuum gripper 100. The battery pack 122 is electrically connected through the handle portion 110, to the pump portion 130, to supply power to the pump portion 130.

Various operating controls can be provided to control the power supplied by the power supply portion to the pump portion. For example various buttons, sliders, control dials for adjusting the power strength, triggers or other devices can be provided. The power operating control can be arranged to remain at the "on" position until a user turns it to "off". This enables the user to retain full functionality of their hands for safely lifting the vacuum gripper. Alternatively, as a safety mechanism, power knob 124 may only be "on" as long as it is depressed by a user, and changes to "off" when released. Such an arrangement ensures safety and power savings when the vacuum gripper is left unattended, and power savings when in use in a situation where no further air extraction is required.

As shown in FIGS. 7 and 8, the battery pack 122 is further electrically connected to a power knob 124 arranged at the first end 111*a* of the handle portion 110*a*. The power knob 124 can be actuated by a user to operate, i.e., turn on and off and vary the power supply to, the pump portion 130. In this case, the power knob 124 is a press-release button, i.e., requires being held down and depressed to supply power to the pump portion 130. There is also an ON/OFF button 126 at the second end 111*b* of the handle portion 110, which in the "off" state can allow the battery to be charged, and in the "on" state allows power supply to the pump portion.

The pump portion cart comprise a pump, impeller, or other air extraction mechanism/device, and as described above can be disposed partly in the handle. The pump is fixedly mounted to the base portion, either directly or via the handle. Such a fixed arrangement provides structural integrity. The pump can comprise a filtering arrangement, such as a filter and filter holder for filtering air passing through the pump to avoid ingress of particulates which could damage the pump, or impair its operation.

As shown in FIGS. 7 & 8, the pump portion 130 can include a pump 132 disposed partly in the second end 111*b* of the handle portion 110, and partly continuing into the handle portion 110, extending partly through the handle portion 110 in a direction towards the first end 111*a*. The pump 132 is a vacuum pump, i.e., arranged to extract air as will be described further below. The end of the pump 132 disposed towards the first end 111*a* of the handle portion 110 is electrically connected to, and powered by, the battery pack 122 of the power supply portion 120. An opposite end of the pump 132 is disposed in the second end 111*b* of the handle portion 110, separated from the base portion 140 by means of a filter holder 134 arranged to contain a filter 136. The filter 136 is arranged to prevent ingress of particles to the pump 132 during pump operation as air is drawn into and through the pump 132 via the filter 136.

The filter holder 134 and filter 136 are fluidly connected in a sealed manner to a hole 146 passing through the base element 141 from the first side 141*a* of the base element 141 to the second side 141*b* of the base element 141.

As can be seen in FIGS. 7 & 8, the first and second sides of the rigid base element define therebetween a thickness of the rigid base element along its central axis, and the second side 141*b* of the base element has a central area 160 and a periphery 180 surrounding the central area 160 and bounded by a peripheral rim 180*a* radially spaced thereby from the central area.

The vacuum seal element 145 is attached at an attachment portion 145*a* thereof to a peripheral support area 180*b* constituting a part of the periphery 180 of the second side of the base element 141, and the attachment portion 145*a* has an attachment surface 145*f* in contact with peripheral support area.

The vacuum seal element 145 can further include a protruding portion 145*b* free of contact with the base element and protruding therefrom in a direction away from the first side 141*a* to a predetermined distance D1. The protruding portion is co-extensive with the attachment portion 145*a* along the peripheral support area 180*b*. The surface of the protruding portion 145*b* of the vacuum seal element 145 which is distal from the second side 141*b* is a contact surface 145*c* for contacting an object surface.

The vacuum seal element 145 can further include an inner encircling surface 145*d* oriented transversely to and extending from the contact surface 145*c* and partially facing towards the central area 160 to define therewith a chamber 170 along the protruding portion 423. The vacuum seal element 145 also can include an outer encircling surface 145*e* oriented transversely to and extending from the contact surface 145*c* and facing away from the central area 160 and the chamber 170, the peripheral rim 18*a* of the second side of the base element protruding outwardly from the outer encircling surface. Thus, the contact surface 145*c* and the attachment surface 145*f* of the vacuum seal element both extend between the inner and outer encircling surfaces 145*d* and 145*e*, and the contact surface 145*c* is co-extensive with the attachment surface 145*f* along the peripheral support area 180*b* of the second side of the base element.

As seen, the predetermined distance D1, to which the protruding portion 145*a* protrudes from the second side of the rigid base element, does not exceed a thickness T of the protruding portion between the inner and outer encircling surfaces. More particularly, the thickness T of the protruding portion is greater than the predetermined distance D1.

The vacuum seal element is disposed closer to a peripheral rim 180*a* of the second side 141*b* than the central area 160 of the second side 141*b*, and has a loop shape. By loop shape, what is meant is that the vacuum seal element sealingly encircles the chamber 170. The loop-shape can be an annulus, i.e., circular, or can comprise any other shaped circuitous structure, i.e., a closed boundary, e.g., an elliptical shape.

The vacuum gripper can be used on a variety of surfaces, including smooth and textured surfaces. This is because the deformability of the contact surface of the vacuum seal element 145 of the vacuum gripper 100 allows conformity of the vacuum gripper 100 with the surface of an object to be carried, thereby ensuring a sufficient vacuum can be achieved, even when the external surface can be textured, i.e., it is not a smooth surface.

By vacuum, what is meant is that an ultimate pressure in the enclosed chamber is substantially below atmospheric pressure. For example, having a pressure in the range of 50-80 kPa.

The vacuum gripper 100 can be used to pick up, support, hold, place, and release items such as boxes, pieces of furniture, panels and other heavy, bulky, fragile, or difficult to grip items. When the user desires to release the item from the grip of the vacuum gripper, a simple release mechanism can be provided which causes a gap in one of the surfaces of the enclosed chamber, allowing ingress of air, causing loss of vacuum, loss of grip and separation of the vacuum gripper 100 and the external surface of the item.

Figure 9:
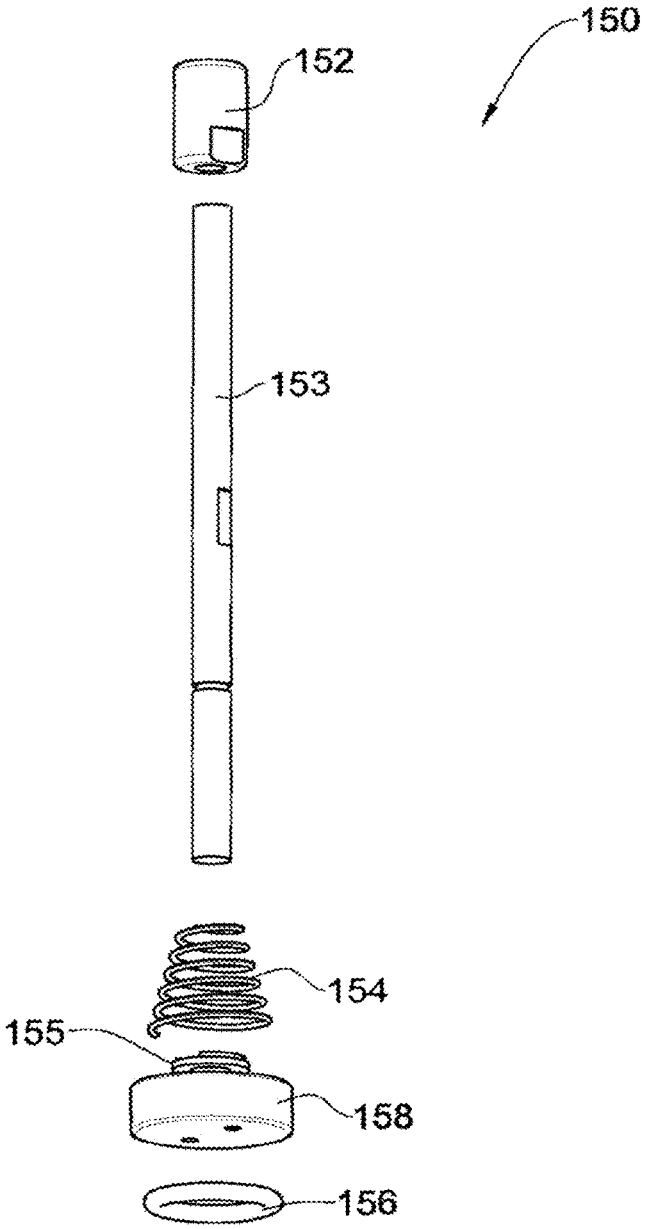
FIG. 9 is a side perspective view of a user-selectable vacuum release for the example portable grip device of FIG. 7.

In the example shown in FIGS. 7 & 8 and more specifically in FIG. 9, the mechanical release is provided in the form of release mechanism 150, having release button 152 provided at the first end 111*a* of the handle portion 110. Release button 152 is connected via a shaft 153 to a blocking component 158 located at the second side 141*b* of the base element 141 via a hole in the base element 141. A surface of the blocking component 158 which faces the second side 141*b* of the base element 141 can include an annular channel into which an O-ring or other sealing component is placed. The O-ring or sealing component has a larger diameter than, and surrounds, the outer circumference of the hole in the base element 141 through which the shaft 153 passes. A compression spring 154 urges at one end against a circlip 155 on the shaft 153 and at the other against the upper surface of the main base element 141, i.e., against the upper surface 140*a* of the base portion 140. This causes the blocking component 158 to be biased and pulled upwards and compress the O-ring or sealing component between the blocking element 158 and the second side 141*b* of the base element 141. This creates an effective airtight seal against air leakage into the enclosed chamber when a vacuum is in place.

In the event that the user wishes to release the gripped item, the user can first release the press-release power knob 124 and/or turning "off" the ON/OFF button 126 to turn off the supply of power to the pump portion 130. This will enable easier release once an attempt to separate the item from the vacuum gripper 100 is made. The user can then depress the release button 152. This urges the shaft 153 downwards against the biasing force of the spring 153 and pushes the blocking element 158 and the O-ring or sealing component away from the underside of the main base element 141, to allow ingress of air into the enclosed chamber. The pressure in the enclosed chamber increases to atmospheric pressure and the vacuum gripper 100 can simply be lifted away and removed from the external surface of the item.

Since both the power button 126 and the release button 152 are conveniently placed next to each other at the first end 111*a* of the handle portion 110, a user can simply and easily use a single digit, e.g., a thumb or forefinger, to press each button in succession to release the vacuum gripper 100 from the external surface of the item.

The strength of the vacuum provided by the vacuum gripper can be sufficient to enable lifting of an object to which the vacuum gripper is attached.

Captive Connection Mechanism; Attachment/Detachment Connection Options

Figure 10:
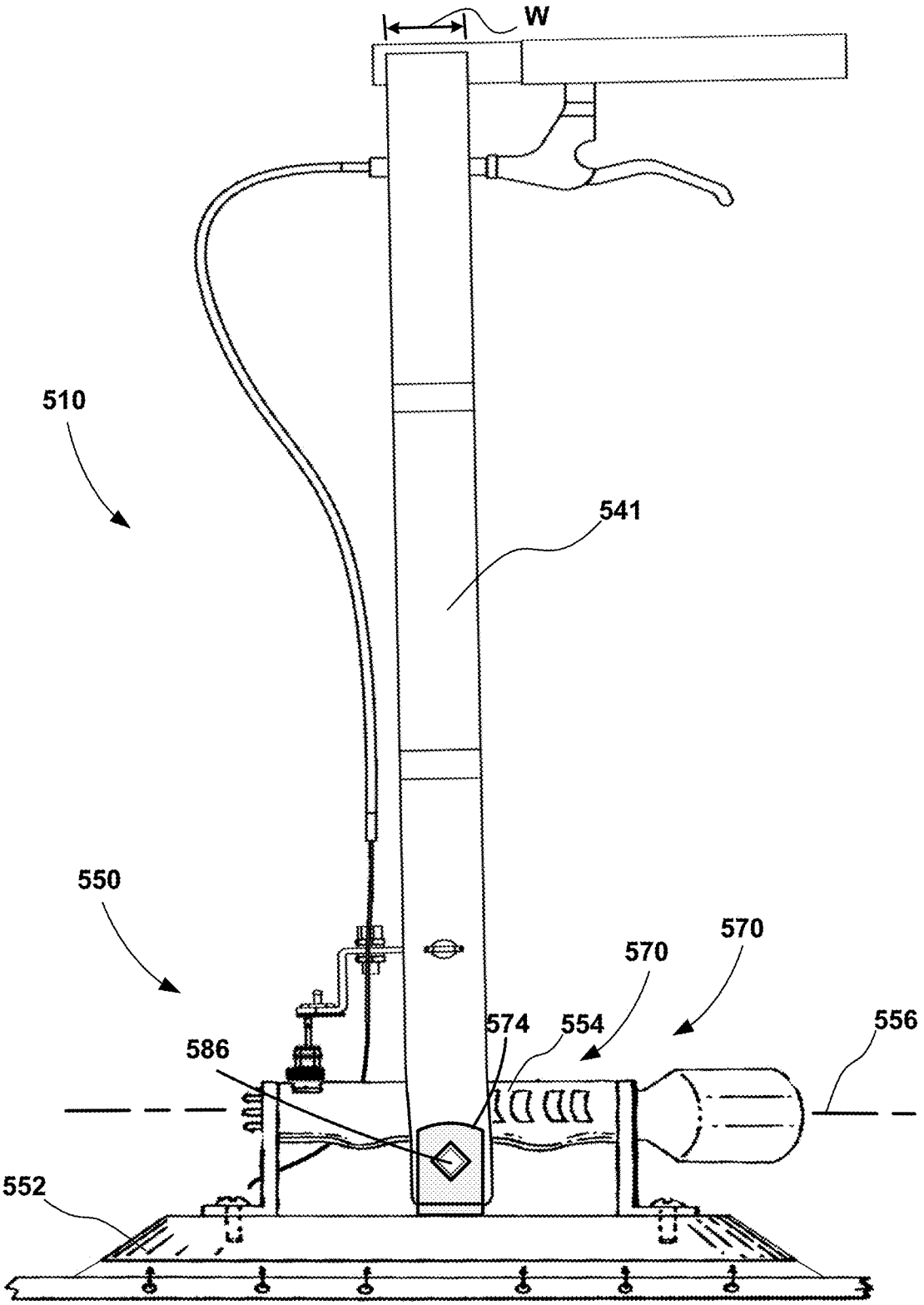
FIG. 10 is a side elevation view of another example control handle attached to the example portable device of FIG. 1.
Figure 11:
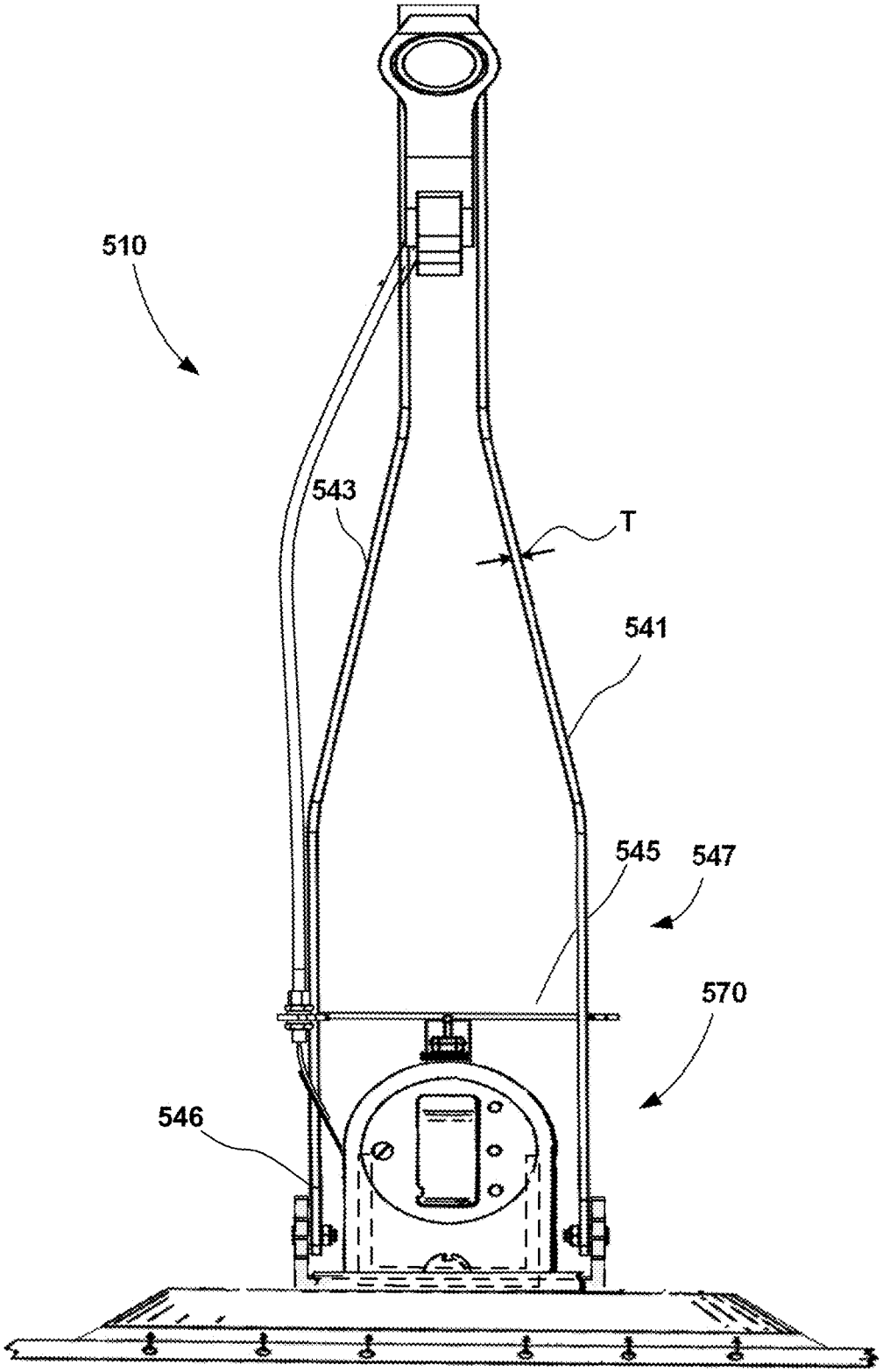
FIG. 11 is a front elevation view of the example control handle of FIG. 10.
Figure 12:
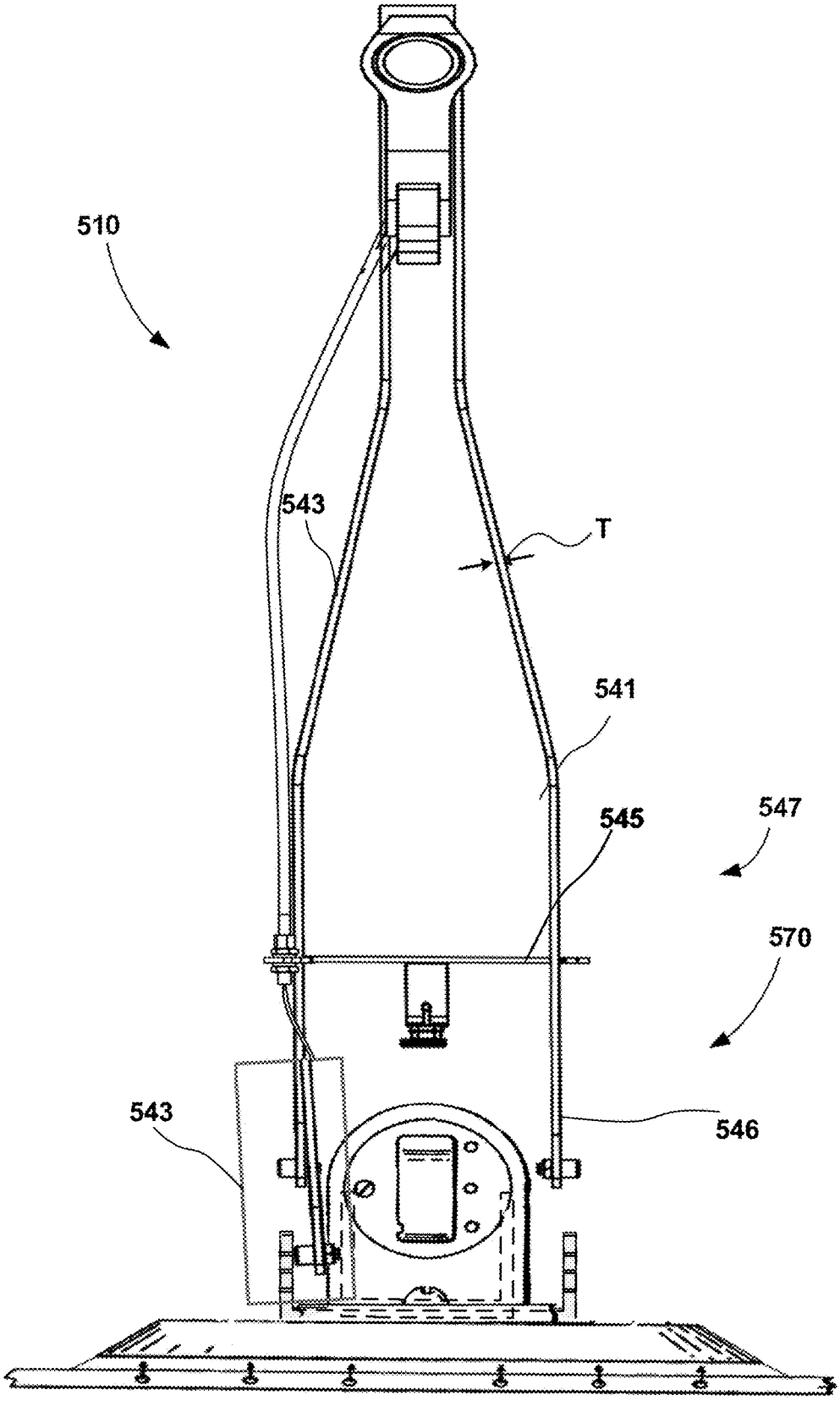
FIG. 12 is a front elevation view of the example control handle of FIGS. 10 and 11 shown in a partial exploded view prior to attachment with a portable grip device.

Referring now to FIGS. 10-12 along with FIGS. 13A-C, core features and common principles for effective attachment and usage of control handle systems will generally be shown and discussed for an extended lift system 500 formed from a combination of a detachable control handle 510 with a portable grip device 550. Various aspects, concepts and features pertaining to the present disclosure and descriptions will now be described in the context of these and other example systems and devices.

Portable Grip/Vacuum Device

Portable, vacuum-based devices related to various aspects, features and concepts described herein have effectively and repeatedly:

- Established secure, high-load connections with other devices or object without using tools or fasteners.
- Provided a 'base' for extended platforms and controllers.
- Quick-change configurations and operations:
  - Interact/Operate vias waist-high control input;
  - Quickly switch to a high flexibility and maneuverable independent unit;
  - Provide amplified-force responses and functions under pre-established arrangements or via other connection/attachment/Interface.
  - Enable 'lockout'; force-avoidance and/or 'captive connection' arrangements for establishing desired connections and limiting/avoiding others.

As shown in FIGS. 10 & 11, portable grip device 550 generally includes a rigid frame 552, a handle 554 attached to the rigid frame and oriented along a primary axis 556, and an interface 570 configured for attachment with a detachable control handle 510. In the present example, the portable grip device 550 makes use of a supplemental or retrofit interface attachment 570 as shown in FIG. 13C, which can be added to an existing grip device and older vacuum grip devices for enabling interface operations, such as with a vertical control extension.

As shown in FIG. 13C along with FIGS. 10-12, the portable grip device 550 can include (e.g., as an attachment) an interface 570 having a pair 572 of spaced apart opposing connector tabs 574, 576 oriented parallel with the primary axis 556, Each connector tab 574, 576 has an offset retention surface 578, 580 on an inboard side forming a parallel captivation channel 582,584; each connector tab defines a connection opening 586, 588 extending between the inboard and outboard side, wherein the interface is configured to form a captive connector attachment with the detachable control handle. FIGS. 13A & B show optional interface attachments as appropriate depending on the interface components required.

Figure 14:
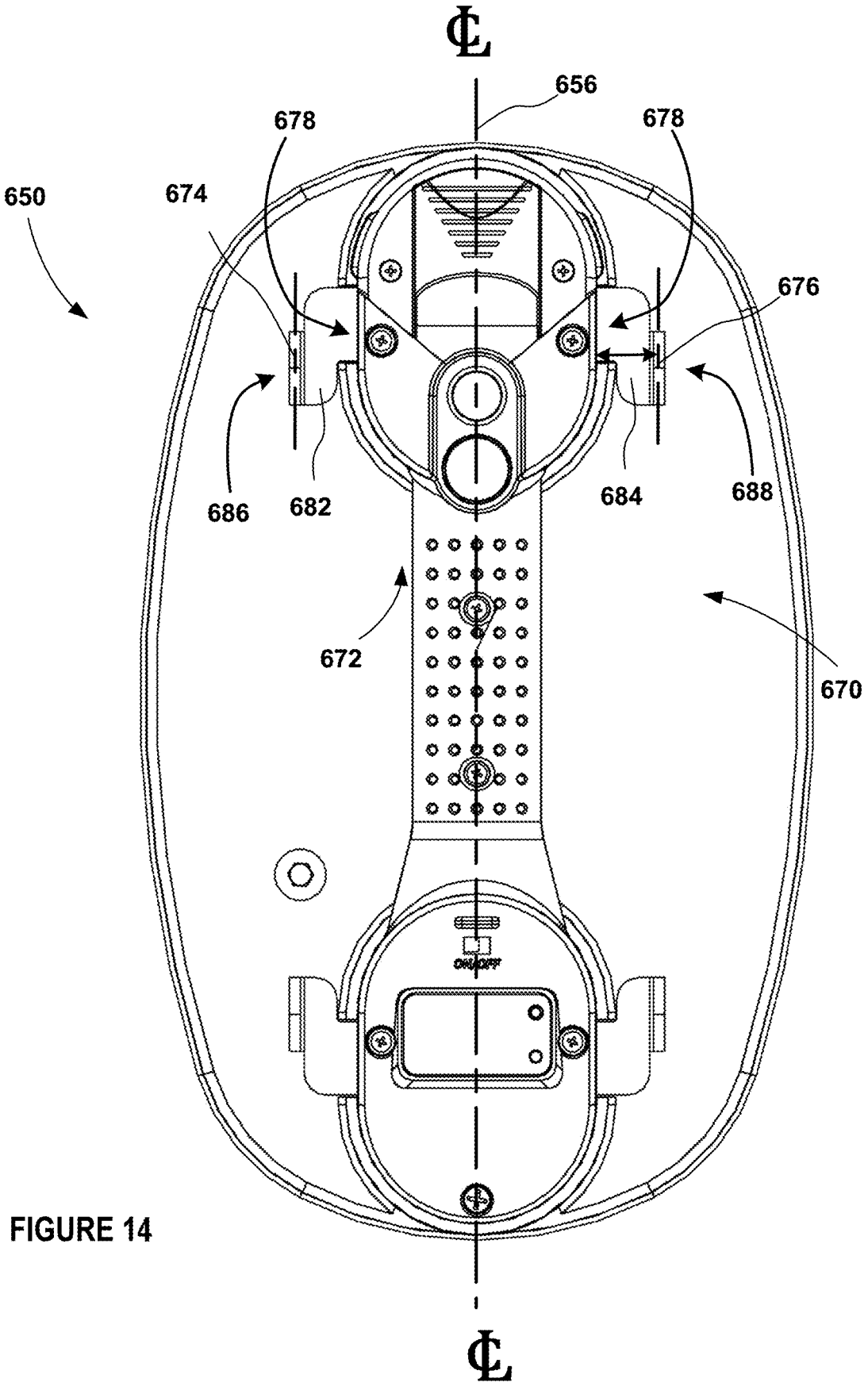
FIG. 14 is a top view of an example portable grip device according to aspects and features described herein.
Figure 15:
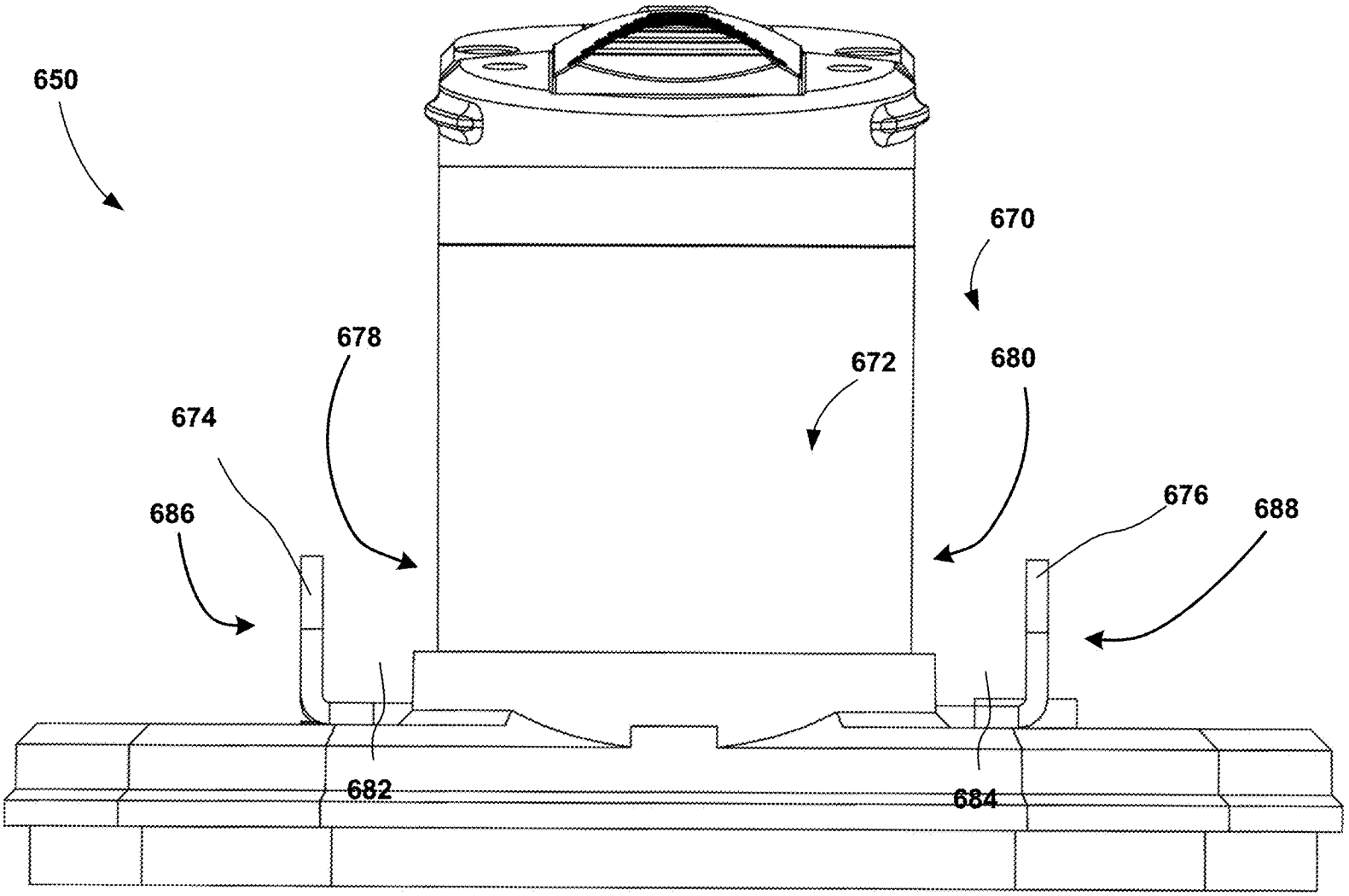
FIG. 15 is a rear elevation view of the portable grip device of FIG. 14.

As a readily understood comparative example with another arrangement of a portable grip device 650 shown in FIGS. 14 & 15, the portable grip device 650 similarly includes an interface 670 having a pair 672 of spaced apart opposing connector tabs 674, 676 oriented parallel with the primary axis 656. Each connector tab 674, 676 has an offset retention surface 678, 680 on an inboard side forming a parallel captivation channel 682,684; each connector tab defines a connection opening 686, 688 extending between the inboard and outboard side, wherein the interface is configured to form a captive connector attachment with the detachable control handle. FIGS. 13A & B show optional interface attachments that can be added as appropriate for any lacking interface features.

Extended Controller/Control Handle

Referring now to FIGS. 11 & 12 along with FIG. 10 as a starting point, an extended controller/control handle 510 includes a pair of opposed support arms 541, 543; a pair of engagement members 546 (FIG. 12) attached to second end portions of the support arms; and a pair of opposing connector pins each having a pin length, P2, that is less than the channel width, P1, in which each pin partially extends through one of the engagement members and is oriented perpendicular to the primary axis (FIG. 12).

As further shown in FIGS. 11 & 12, a crossarm 545 extends between the pair of support arms 541, 543 in a direction perpendicular to the primary axis. The crossarm 545 is configured to establish a preset inboard spacing between the pair of support arms 541,543 at a crossarm interface 547 proximate the second end portions of the pair of support arms 541,543, which includes establishing spacing for the pair of opposing pins having lengths P2 and for the pair of engagement members 546.

Thus, as shown and described along with FIGS. 11 and 12 in a simplified extended control device arrangement 510, the interface includes a pair of spaced apart opposing connector tabs oriented parallel with the primary axis and extending from a rigid frame of the portable grip device, each connector tab having an offset retention surface on an inboard side forming a parallel captivation channel having a channel width, P1, in a direction perpendicular to the primary axis, and each connector tab defines a connection opening extending between the inboard and outboard side.

In addition, as clearly depicted in FIGS. 11 and 12 in comparison with FIG. 10, each of the support arms 541 have a width, W along a fore-aft direction across a face of a support arm and parallel with the primary axis 556 of the portable grip device, which is about twelve (12) times as thick as thickness, T, in a direction perpendicular to width W. Further, each support member 541, 543 includes bends 549, 551 formed along each support arms at the same position along corresponding support members, and arranged as mirror image bend for the opposing support arms. The bends 549, 551 include a pair of bends along each support arm in opposite directions forming a mild z-bend in each of the support arms parallel with the primary axis.

As such, each of the support arms are configured for maintaining high stiffness properties in a direction parallel to the primary axis based on geometry of the support arms including width vs. thickness and corresponding arrangement; shape and orientation of the support arms, and z-bar bends induced therein. Further, each of the support arms are configured to provide and enable high flexibility and easy bending characteristics in a direction perpendicular to the primary axis based on geometry of the support arms including width vs. thickness and corresponding arrangement; shape and orientation of the support arms, and z-bar bends induced and oriented along the support arms for encouraging bendability.

Referring now specifically to FIG. 12, a slightly exploded view of detachable control handle 510 is shown, or rather, detachable control handle 510 depicted separate, apart from, and detached from the portable grip device 570. As such, connection and alignment features can be viewed more clearly for the extended lift system 500 vs. FIG. 11. Note further that FIG. 12 includes a copy of an end portion of each of the engagement arms 546A shown at an offset orientation of about three (3) degrees inboard with respect to the corresponding engagement arm and pin as discussed further below.

As discussed above along with FIG. 10, the portable grip device 510 includes an interface 570, which has been added as a supplemental or retrofit modification to the portable grip device 510. The interface 570 includes a pair of captivation channels each having a channel width, P1, as shown in FIG. 12. As discussed above regarding the detachable control device 510, the pair of engagement members 546 and the pair of opposing pins extending therethrough and having a length P2 are placed in an attachment arrangement based on the crossarm establishing the preset inboard spacing between the pair of support arms 541. As such, the portable grip device 560 and the detachable control device 510 are placed in a matching, post-installation arrangement for engaging each other appropriately and cooperating as an overall extended lift system 500, but prior to connecting with each other and establishing an attachment arrangement.

In other words, according to aspects and features pertaining to methods for establishing an attachment arrangement between a portable grip device and a detachable control device, establishing an attachment arrangement can include placing interface components for each of the portable grip device and the detachable control device in a post-installation arrangement, and proceeding with engagement of the portable grip device with the detachable control device. In other words, arranging the engagement members 546 and pair of pins attached thereto in alignment with the pair of captivation channels 546A of the portable grip device, and proceeding to insert the pair of pins and engagement members into the captivation channels and establish a connection with the detachable control device.

However, each of the detachable control device and the portable grip device are placed in a matching post-installation arrangement prior to establishing a connection and installation, the interference occurs between the engagement members, the pair of pins and the interface 570 that prevents the connection, such as the pair of pins being unable to engage the corresponding transverse openings through the pair of post connectors despite the pair of engagement members being aligned with the cavitation channels. In short, according to actions and methods for establishing an installation arrangement as described herein, actions are pursued for fully establishing an installation arrangement including practicing the installation arrangement prior to forming a connection between the corresponding devices, followed by establishing the connection and captivating the connection for securing the installation arrangement. For the present example shown in FIG. 12, the connection would include the pair of engagement members and corresponding pair of pins fully engaging the pair of captivation channels, followed by captivation of the pins and engagement members.

When the portable grip device and detachable control device have been placed in the matching post-installation arrangement, the users can bend or flex the engagement members at a slight inboard angle of about three degrees to five degrees for establishing a connection between the portable grip device and the detachable control device followed by captivation of the connection after each of the pair of pins have been fully established within the transverse openings. Thus, the portable grip device and the detachable control device can readily and securely be secured in an installation arrangement without the use of tools or connectors.

Further, such a connection and installation arrangement can be maintained and secured until one party or the other chooses to terminate it. Referring now to FIG. 13C, a primary frame 581 of the detachable control handle device, extension member, or control handle is generally shown, which merely includes an elongate control handle centered along a highly flexible lifting band, which has very high stiffness and strength properties along fore and aft directions parallel with elongate handle, and enhanced bending and flexibility properties perpendicular with the fore and aft directions, such that when a load is applied the primary frame 581 readily flexes into engagement with attachments for the primary frame. Upon installation of the crossmember in a generally cantilevered arrangement, the primary frame 581 exerts an outboard rotation bias to the extension members maintaining and securing the installation as desired.

Extended Controller

Figure 16:
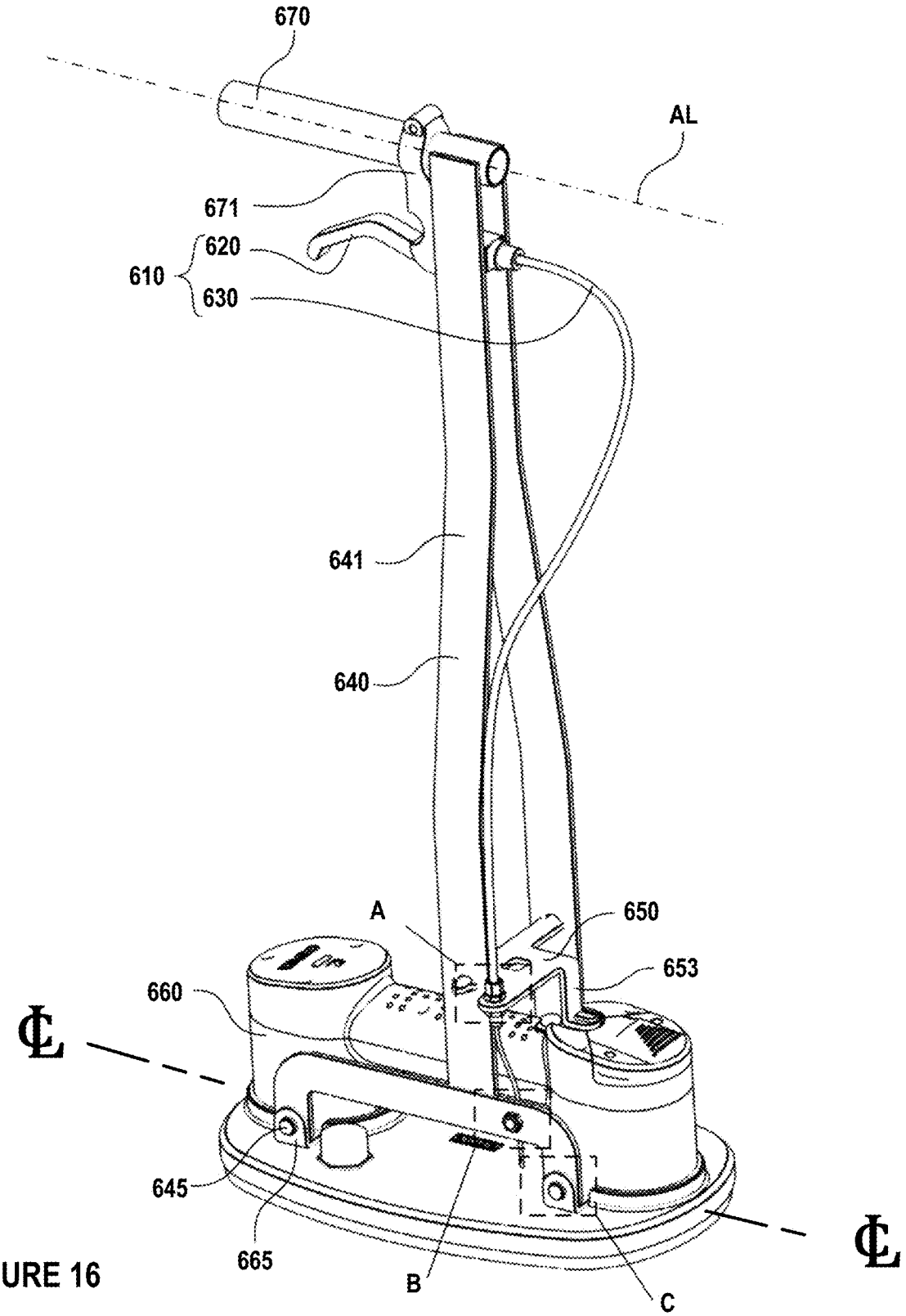
FIG. 16 is side perspective view of an elevated control handle device attached with an example portable grip device according to aspects and features described herein.

Referring now to FIGS. 16-24, the extended controller 610 includes a handle 670, an operating part 610, a support arm 640 and an actuator 650. Extended controller 610 can be installed onto portable grip device 660. The portable grip device 660 as shown in FIGS. 14-16 includes a release button 663 on the top. After the suction device (such as a suction pump) of the portable grip device 660 starts operating and clamping on the object, the chamber under negative pressure in the portable grip device 660 will have air flow in by pressing the release button 663 on the top of the vacuum lifter, thus releasing the object.

Figure 17:
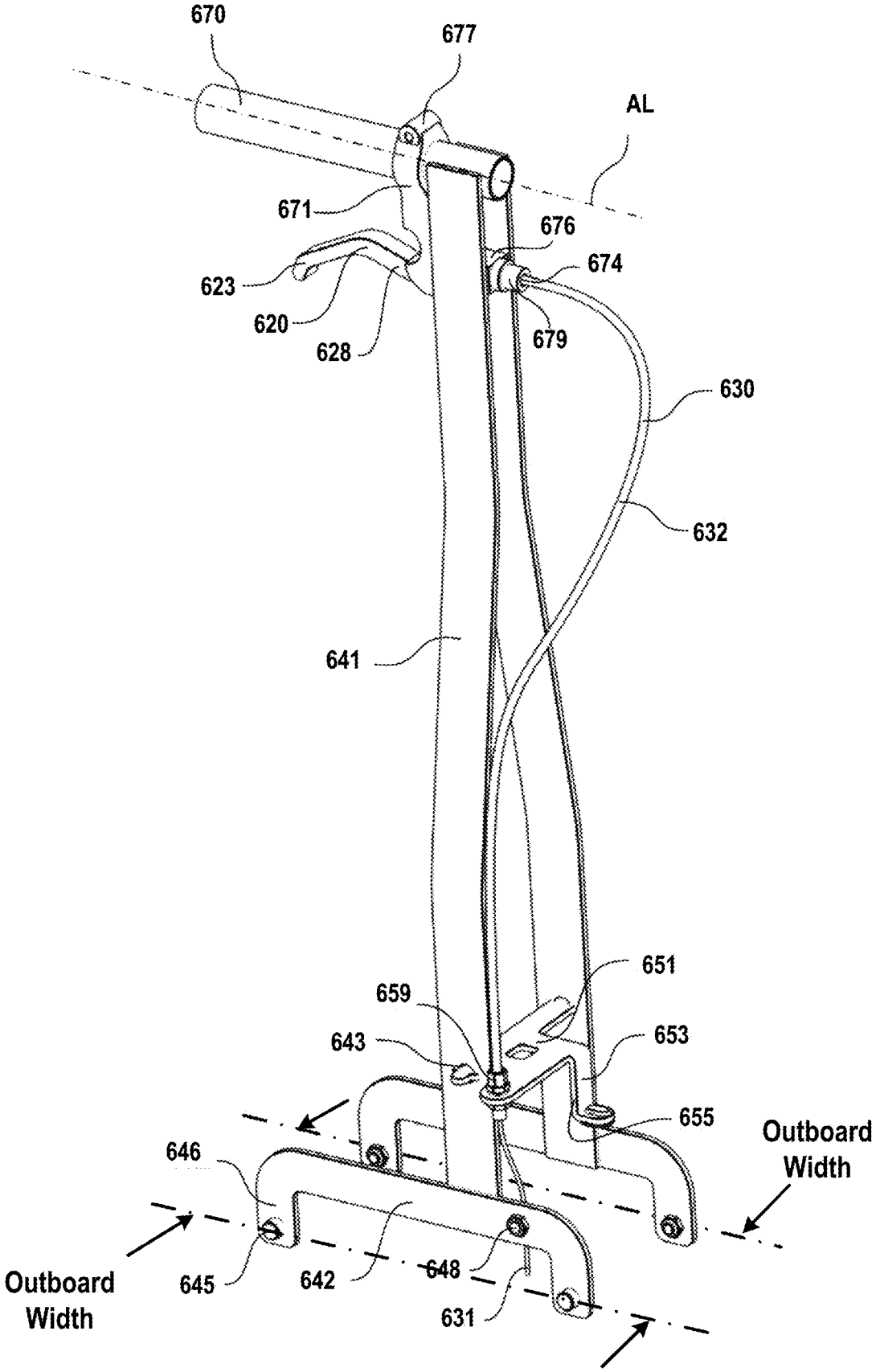
FIG. 17 is a side perspective view of the elevated control handle device of FIG. 16 shown in a detached arrangement with the portable grip device.
Figure 18:
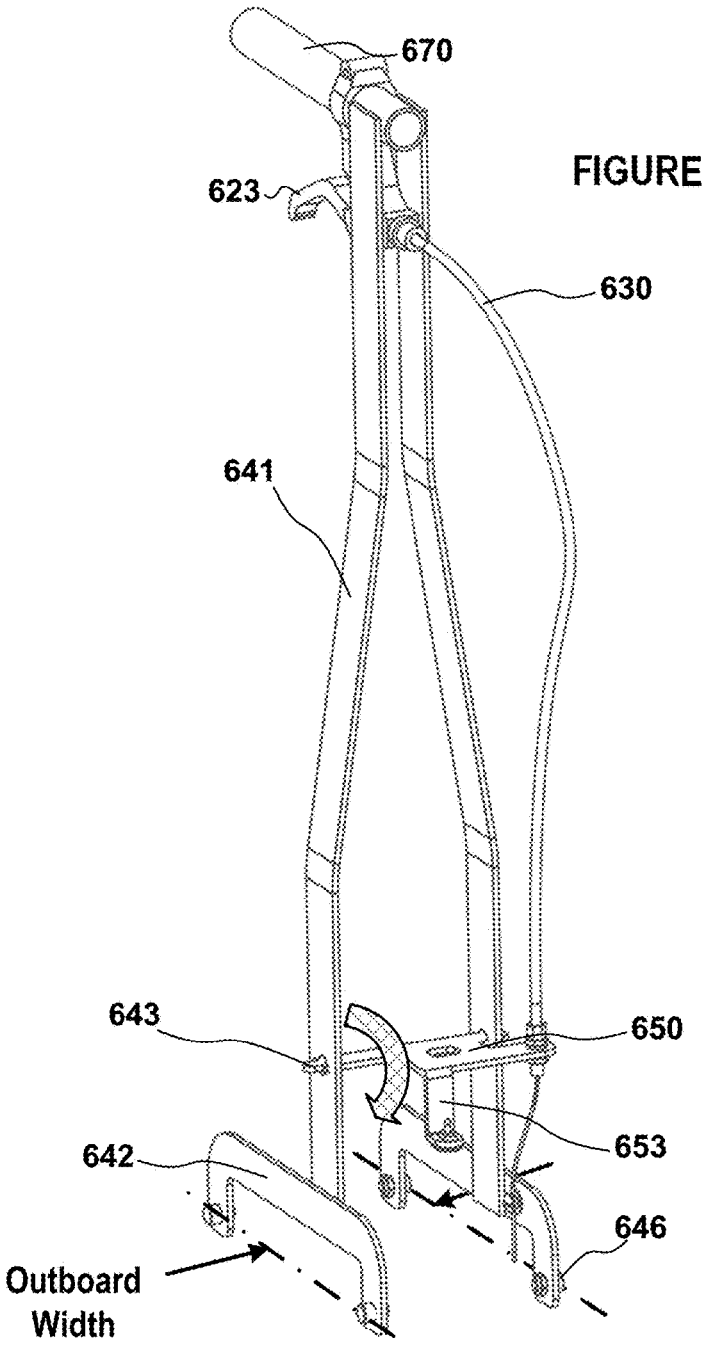
FIGS. 18 and 19 are front perspective views of a partial exploded view arrangement of the elevated control handle device and the portable grip device of FIG. 16.
Figure 19:
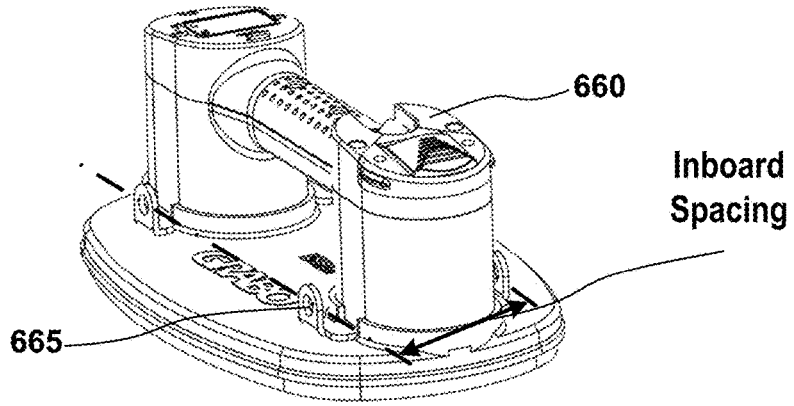

As shown in FIG. 17, the extended controller 610 has a first pair of opposing pins 645 extending at least partially through the corresponding engagement member 642. In FIG. 18, the portable grip device 660 has a second pair of opposing support tabs 665, which can be used with the pair of opposing support tabs 645 to secure the extended controller 610 to the portable grip device 660.

Grip handle 670 is the part for the user to hold. It generally designed in cylindrical structure and has an axial axis AL. Operating part 610 can move toward handle 670 or support arm 640. The upper end of the support arm 640 is connected to the handle 670, and the lower end of the support arm 640 is detachable and can be connected to the vacuum lifter 660.

The installation bracket 671 is connected to the handle 670. The installation part 671 includes port 677 and the first end 676 which is on the opposite direction of port 677. The first end 676 is equipped with the first installation part 679 of the cable. The port 677 is fixed to the handle 670. The first installation part 679 of the cable has a through hole 674 of the installation part. The installation part 671 can be integrated with the handle 670, that is, the installation part 671 is part of the handle 670.

The actuator 650 is moveable and connected to the operating part 610 and the support arm 640. When the extended controller 610 installed on the portable grip device 660, the contact part 653 of the actuator 650 is located above the release button 663. When the movable part 620 of the operating pan 610 is in use, the actuator 650 moves along with the operating part 610 relative to the support arm 640. Specifically, when the extended controller 610 installed with the portable grip device 660, the contact part 653 of the actuator 650 moves with the operating part 610 relative to the support arm 640 to press the release button 663.

The engagement member can include a transverse arm 642 connected to the lower end of the longitudinal support arm 641 so that the support arm 40 is in inverted T shape. The actuator 650 includes the connecting part 651 and the contact part 653 Which connected to the connecting part 651. The support arm 640 includes a support hole 643. The pivot connector 651 should be at least partially inserted into the support hole 643 in order to enable the actuator 650 to rotate relative to the support arm 640. That is, the connecting part 651 can be rotated while connecting to the support arm 640. Contact part 653 is located at least partially below connecting part 651 to contact the release button 663 from the top when the extended controller 610 is attached to the portable grip device 660.

As shown in FIG. 18, the actuator 650 includes a surface 655 perpendicular to the axis of the support hole 643. The surface 655 can be regarded as the side surface of the contact part 653 of the actuator 650. On the surface 655, the cross section of contact part 653 can be L shape, C shape or S shape. In other words, the contact part 653 extends downward from the connecting part 651 of the actuator 650 by bending L shape, C shape or S shape for contacting the release button 63 from the top when the extended controller 610 is secured to the portable grip device 660. As shown in FIG. 18, on the first surface 655 perpendicular to the axis of the supporting hole 643, contact part 53's cross section is S shape.

The movable part 620 includes the operating end 623 and the connection end 628, which is on the opposite of the operating end 623. The connecting end 628 of the movable part 620 is movable while connecting to the first end 676 of the installation part 671. For example, the connecting end 628 of the movable part 620 is pivotable while connecting to the first end 676 of the installation part 671 so that the movable part 620 is connected to the installation part 671 and movable between the stationary position and the operating position. In the meantime, the movable pan 620 is also movable between the static position and the operating position relative to the handle 670 and the support arm 640.

The cable 630, which connected to the movable part 620, is at least partially moveable as the movable part 620 is in motion relative to the installation part 671. Specifically, cable 630 includes inner core 631 and tube 632, which surrounds the inner core 631 and can slide relative to the inner core 631. The first installation part 679 of the cable has a through hole 674 of the installation part. The inner core 631 extends through the actuator via through hole 654 and through hole 674. The upper end of the inner core 31 is connected to the connecting end 628 of the movable part 620. The lower end of the inner core 631 is connected to the support arm 640. Tube 632 is confined between the movable part 620 and the actuator 650 surrounding the inner core 631. Specifically, the tube 632 is limited between the cable's first installation part 679 and the second installation part 659 while surrounding the inner core 631.

The length of the inner core 631 is longer than the length of the tube 632. The length of the inner core 631 between the connecting end 628 and the cable's third installation part 648 is larger than the straight-line distance between the connecting end 628 and the cable's third installation part 648. The length of cable 630 (including inner core 631 and tube 632) between cable's first installation part 679 and the second installation part 659 is larger than the straight-line distance between cable's first installation part 679 and second installation part 659. The length of cable 630 (including inner core 631 and tube 632) between the through hole 674 and the through hole 654 is greater than the straight-line distance between the through hole 674 and the through hole 654.

The lower end of the inner core 631 can be fixed to the support arm 640 by welding and bonding. Specifically, the lower end of the inner core 631 can be detachably connected to the transverse arm 642 of the support arm 640 through bolt 691. Bolt 691 passes through the 644 on transverse arm 642. The inner core 631 threading in the through hole 693 on the bolt 691. After tightening the nut 692, the inner core 631 is clamped between the transverse arm 642 and the nut of the bolt 691. Understandably, the upper end of the inner core 631 can also be connected to the connecting end 628 of the movable part 620 in a variety of ways.

The portable grip device 660 can include a bias component that can apply an upward bias force to the release button 663. When the user releases the movable part 620 and makes it turn back to the static position, the downward force applied by the tube 642 to the actuator 650 disappears, resulting in a decrease in the pressure on the release button 663. Release button 663 pops up under the bias force inflicted by the bias component, isolating the negative chamber of the vacuum suction 660 from the external atmosphere.

As shown in FIG. 18, the portable grip device 660 includes four installation parts 645, which are located at the bottom of the extended controller 660. Specifically, the four installation parts 645 are located at the transverse arm 642 of the extended controller 660. As shown in FIG. 18, the transverse arm 642 consists of a downwardly extended end 646. Four installation part 645 are on the end 646. Preferably, two support arms 640 and four installation parts 645 in the utility model are symmetrically placed on the surface passing through the axis AL of the handle 670 and perpendicular to the pivotal axis of the movable part 620 when it rotates relative to the installation part 671. The extended controller 660 is easy to produce for symmetrical structure like this.

The first installation part 645 and the second installation part 665 can be screwed fittings, buckles, hook connectors, etc. Specifically, the first installation part 645 is constructed as a protruding part 645, and it is protruding towards the outer side of the extended controller 660. The second installation part 665 includes a mounting hole 666 that can be used in conjunction with the protruding part 645. The mounting hole 666 is a through hole. The protruding part 645 is matched with the through hole 666 to connect the extended controller 660 to the second installation part 665.

Figure 20:
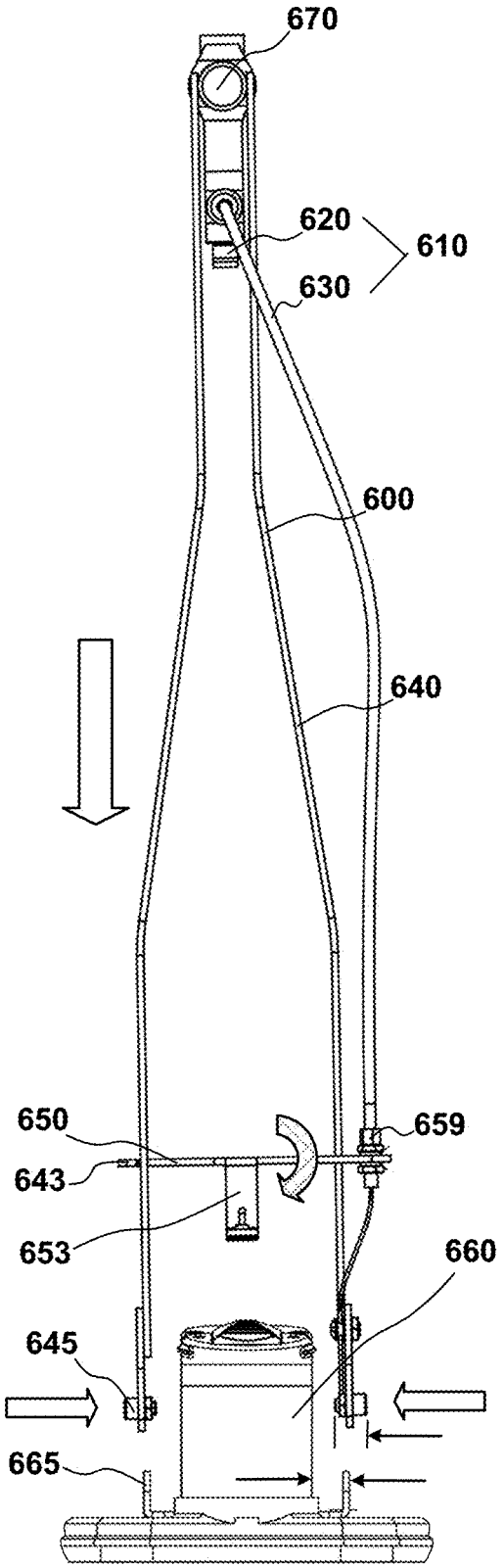
FIG. 20 is a front elevation view of the elevated control handle device of FIG. 18 shown in a partially exploded arrangement with the portable grip device of FIG. 18.
Figure 21:
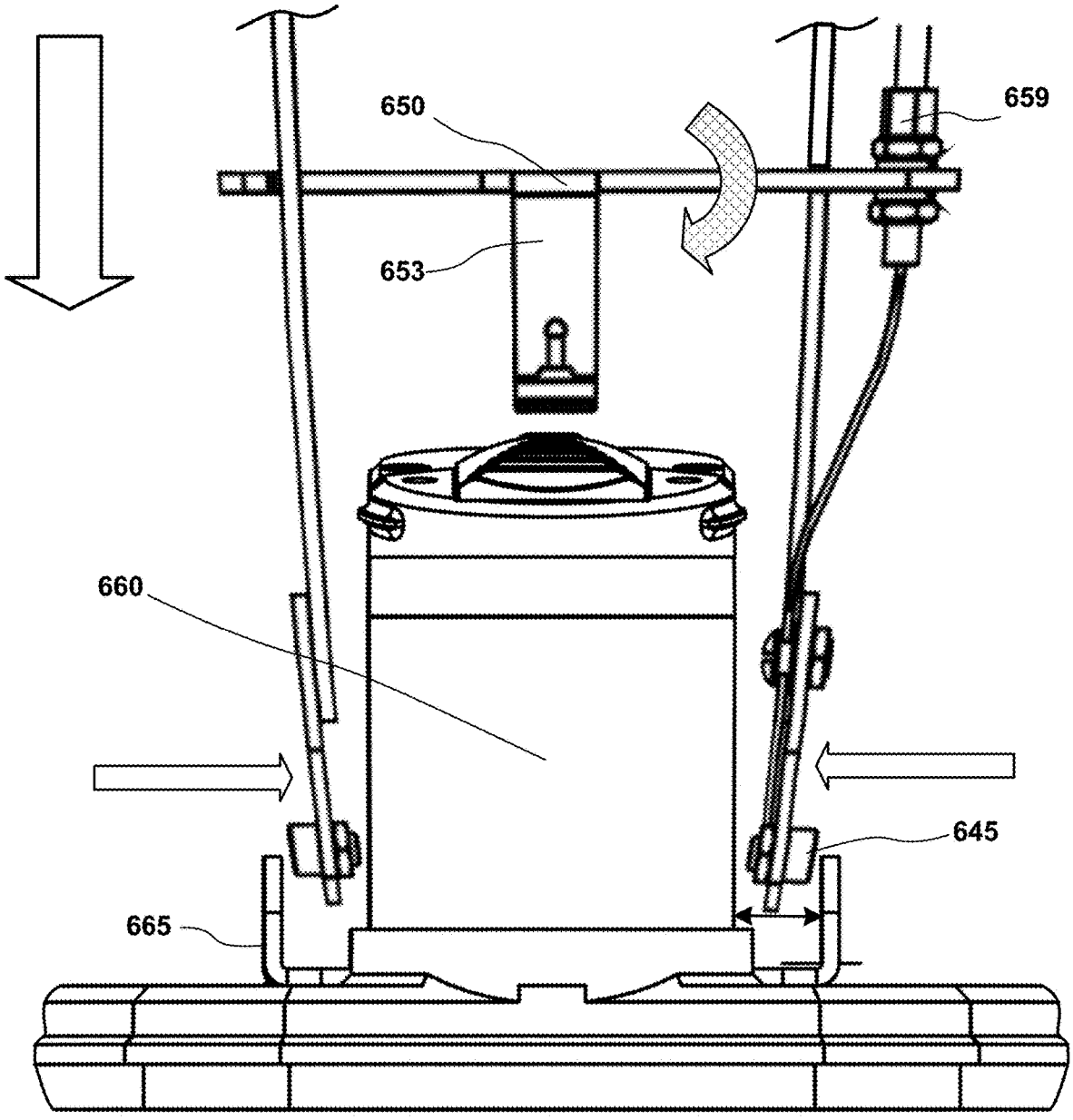
FIG. 21 is an elevational front view of a lower portion of the example control handle of FIG. 20 shown with the portable grip device of FIG. 18 during attachment of the control handle to the grip device.
Figure 22:
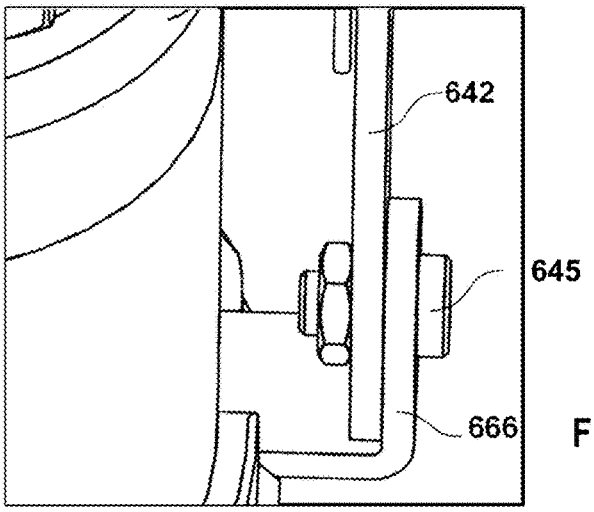
FIGS. 22 to 24 are close views of the example control handle device attached with a portable grip device of FIG. 16.
Figure 23:
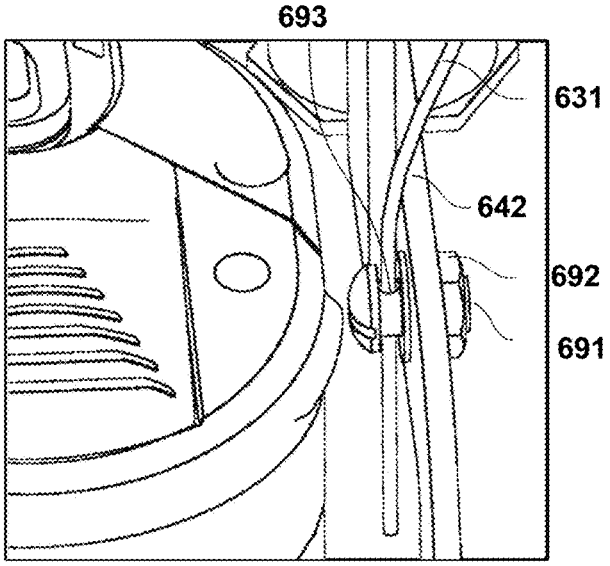
Figure 24:
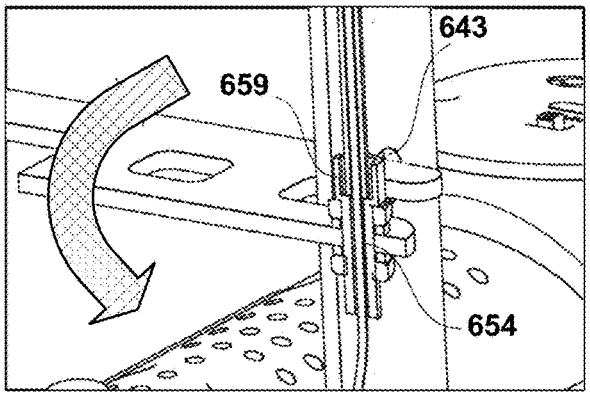
Figure 25:
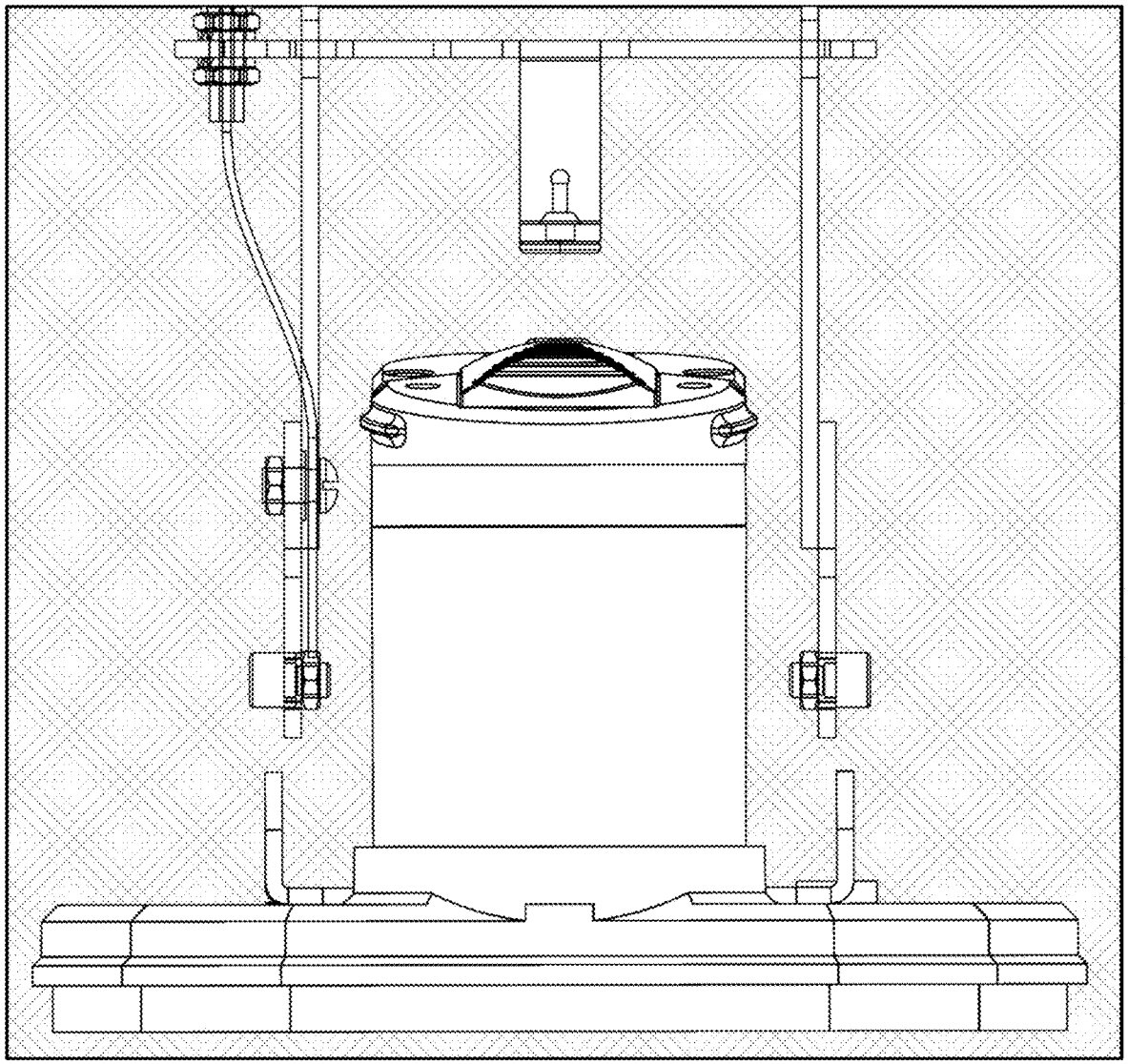
FIG. 25 is front elevation view of a lower front portion of an elevated control handle attached with an example portable grip device, which illustrates an alignment of a pair of engagement members without applying an offset angle.
Figure 27:
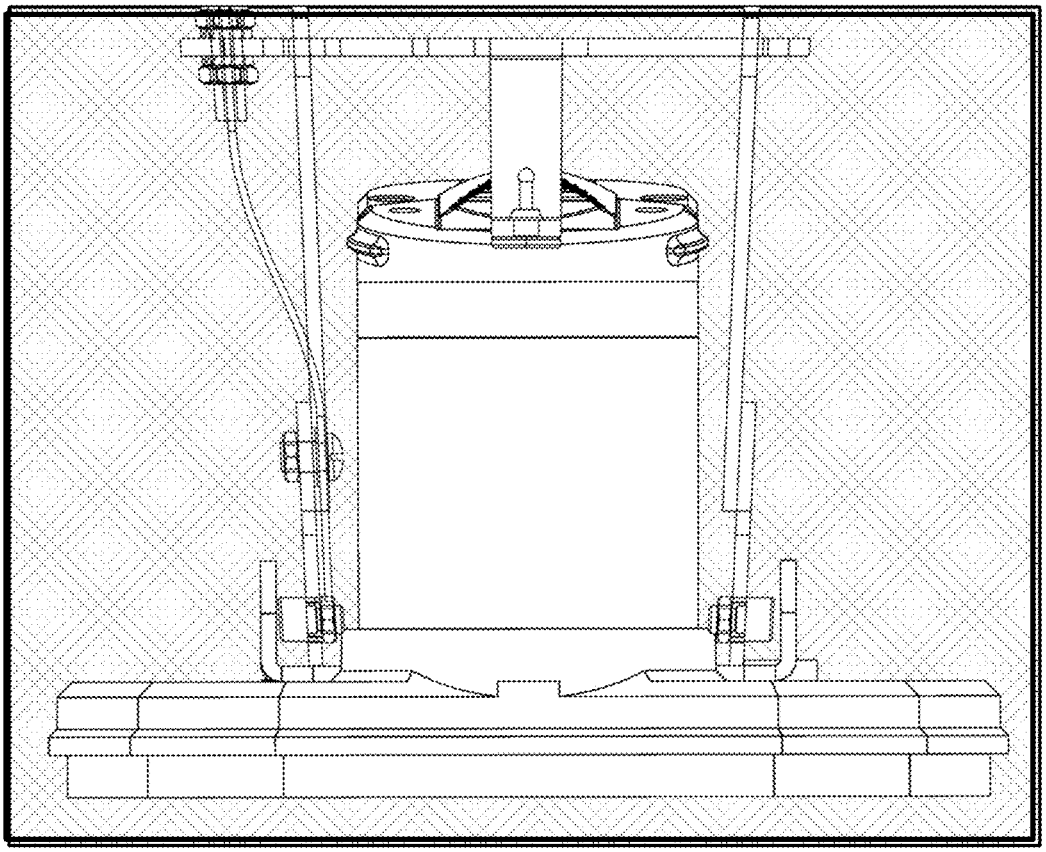
Figure 28:
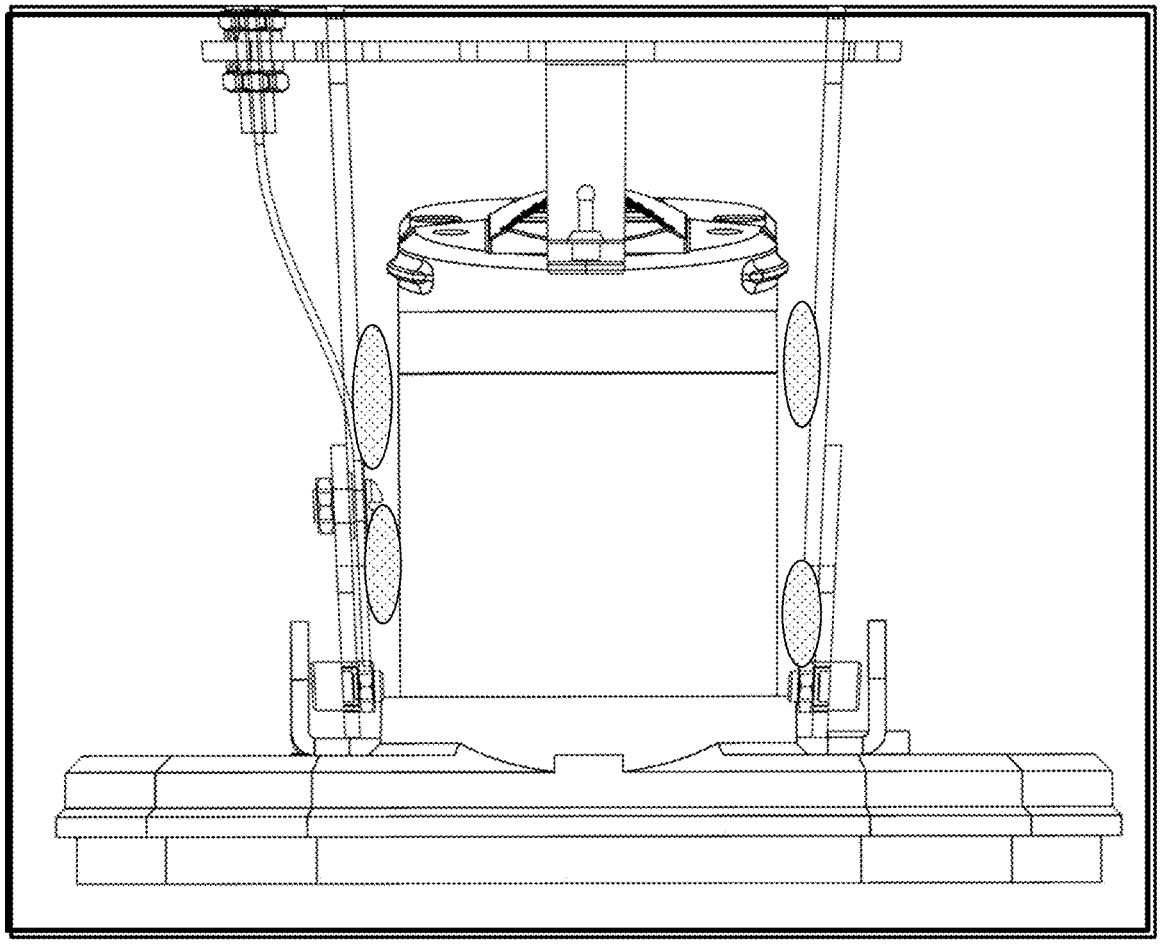
FIG. 28 is a front elevational view of a lower front portion of an elevated control handle shown attached with an example portable grip device, which conceptually depicts exploring selective application of rubberized deposits for user's practicing offset angles.
Figure 29:
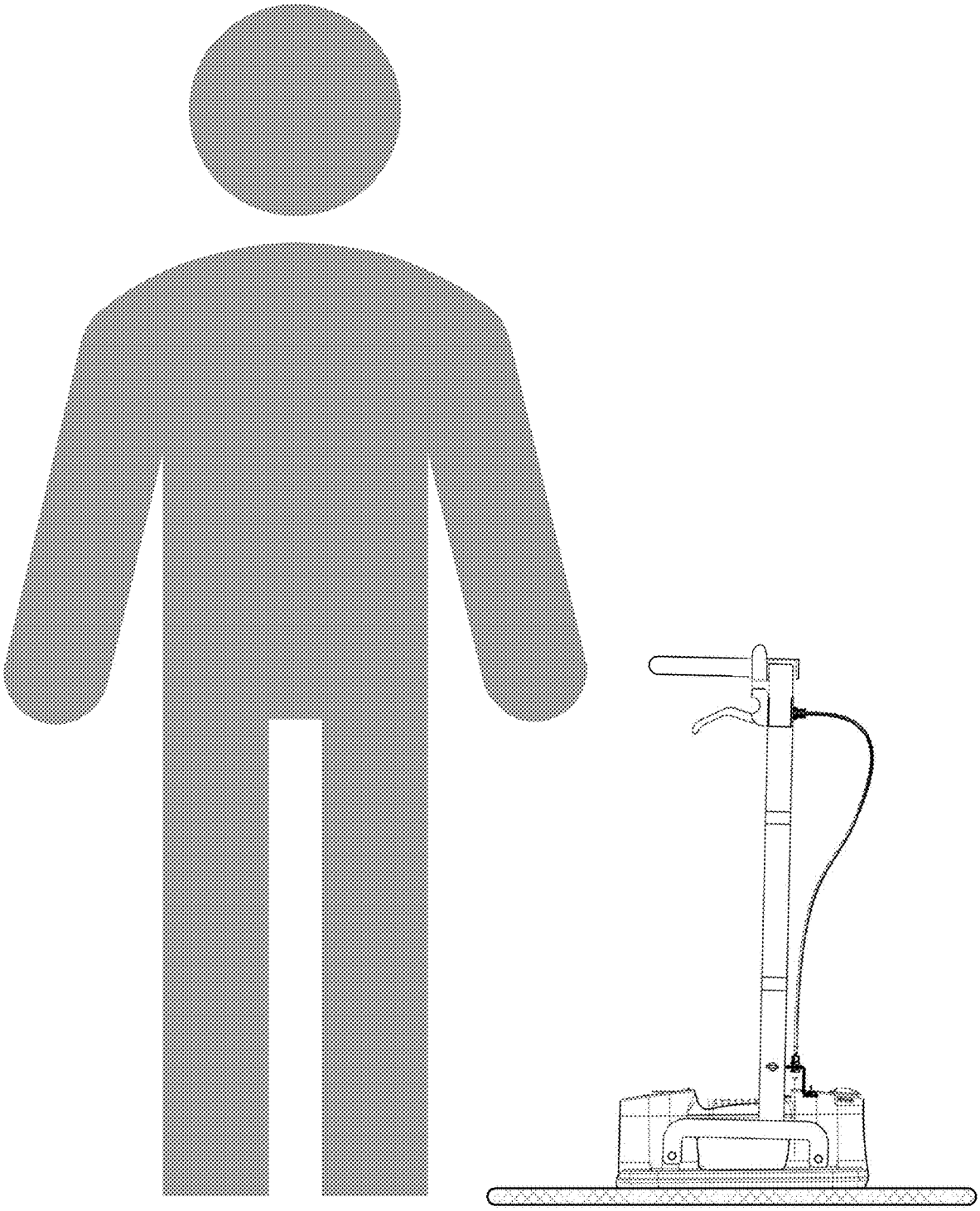
FIG. 29 is a side elevation view of an example portable grip device attached with an example elevated control handle, which are shown along with a depiction of person standing nearby as a silhouette.

Referring now to FIGS. 25-29, front elevation views of a lower region of the extension control device 610 of FIG. 20 are generally shown along with corresponding front elevation views of the portable grip device 660 of FIG. 20, with the exception of FIG. 29 that show the extension control device and portable grip device in a side elevation view. Staring with FIG. 25, a pair of extension members are shown oriented, aligned, and properly arranged with the pair of opposed connectors of the gripper device, which would be case for placement of both the control device and the portable gripper in the 'arranged' configuration. As such, the pair of extension members shown in FIG. 25 are arranged for making interfering contact with the pair of support tabs unless or until the extension members are guided inboard for permitting captivation of the connection and connection arrangement.

Figure 26:
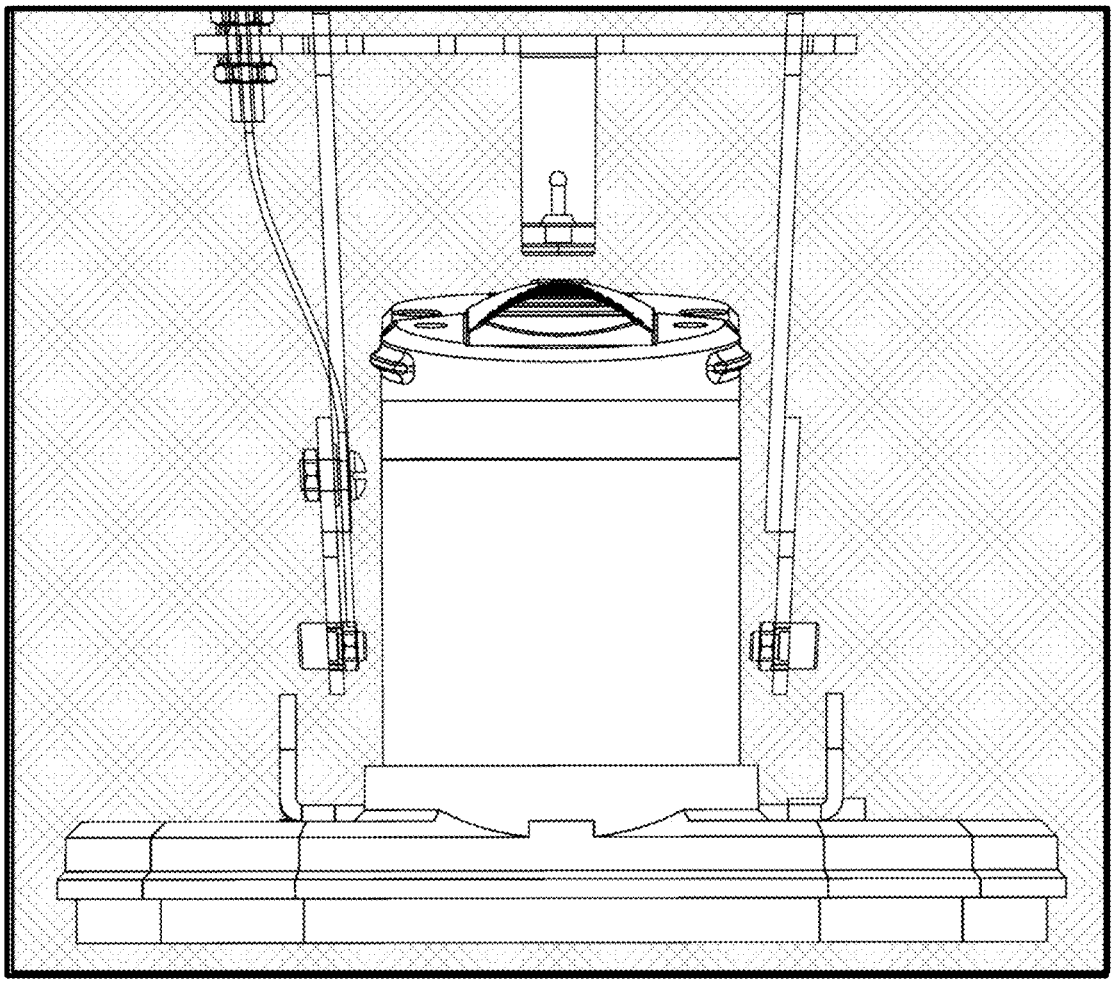
FIGS. 26 and 27 are front elevation views of a lower front portion of an elevated control handle attached with an example portable grip device, which illustrate applied offset rotation angles.

FIGS. 26-28 are depictions of similar views as FIG. 25, but either depicting efforts for 'guiding inboard' to establish a connection and/or showing various interference conditions and misaligned components. FIG. 29 shows a combination device including a portable grip device combined with an expanded control panel, which is shown with a 'silhouette' person providing comparative height information.

Figure 30:
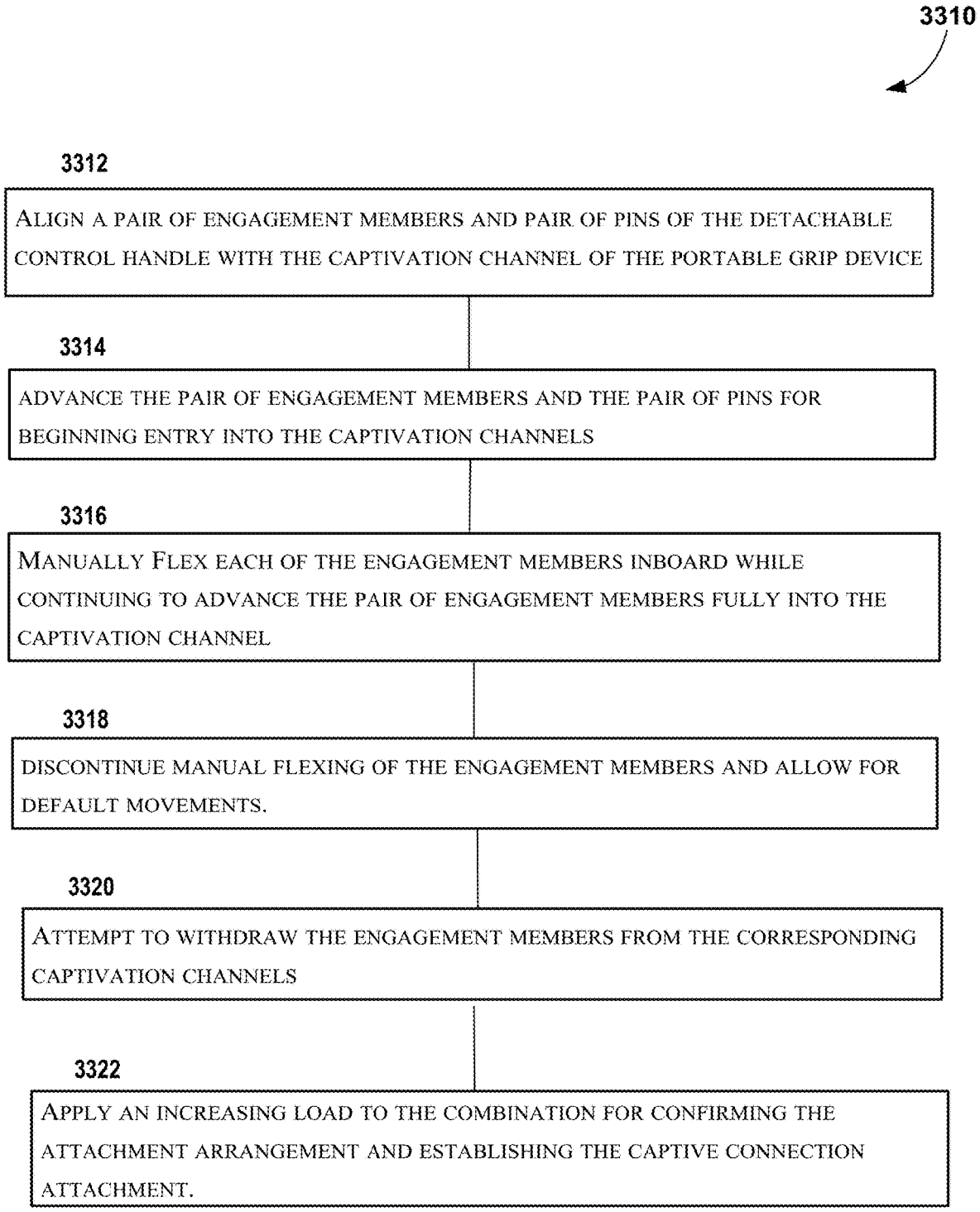
FIG. 30 is a flow chart schematically depicting an example method pertaining to attaching a control handle to a grip device and for using the combination according to aspects and features described herein.

Referring now to FIG. 30, a method for providing ergonomic vertical support for lifting actions using a portable grip device and expanding control of the same is generally shown and described in greater detail below. The method can include configuring the portable grip device to ensure support for a captive connection interface for quickly attaching a detachable control handle without the use of tools or fasteners, in which the captive connection interface can include at least one pair of opposing connector tabs oriented parallel with a primary axis and extending from a rigid frame of the portable grip device. Each connector tab can have an offset retention surface on an inboard side forming a parallel captivation channel therewith, and the captivation channel can have a channel width in a direction perpendicular to the primary axis.

The method can further include providing a detachable extended control handle having a user handle oriented parallel with a primary axis of the vacuum grip device when attached and a pair of opposed support arms attached to the control handle and oriented parallel with the primary axis, in which the support arms can have greater strength and rigidity parallel with the primary axis and greater flexibility perpendicular to the primary axis. The support arms can extend in a downward direction when attached to the portable grip device from the control handle to a pair of engagement members, and the support arms angled apart from each other extending from the control handle toward the engagement members in a balanced arrangement with control handle.

The method can continue with determining an attachment arrangement of the portable grip device including size, spacing and arrangement of the pair of opposing connector tabs and the corresponding pair of captivation channels, and determining, for the detachable control handle, a preset inboard spacing between the pair of support arms at a crossarm interface proximate the second end portions of the pair of support arms, the preset inboard spacing based on the determined attachment arrangement of the portable grip device.

The method can further include engaging the pair of support arms of the detachable control handle to as to establish the preset inboard spacing between the pair of support arms at the crossarm interface via a crossarm extending between and engaging inboard sides of the pair of support arms, wherein the pair of opposed engagement members and the pair of pins have a connection arrangement matching the attachment arrangement of the portable grip device interface for connecting to the portable grip device.

The method can include an additional step of attaching the detachable control handle to the portable grip device, which can include aligning the pair of engagement members and the pair of pins of the detachable control handle with the captivation channel of the portable grip device, and advancing the pair of engagement members and the pair of pins to begin entry into the captivation channels. Further, the method can include flexing manually each of the engagement members inboard while continuing to advance the pair of engagement members fully into the captivation channel, and discontinuing manual flexing the engagement members. The method can continue with attempting to withdraw the engagement members from the corresponding captivation channels, in which the attempting permitting the pair of engagement members and the pair of pins to complete connection with the portable grip device in the absence of manual flex and while within the captivation channels. The method can conclude with applying an increasing load to the combination for confirming the attachment arrangement and fully establishing the captive connection attachment.

The subject matter described above is provided by way of illustration only and should not be construed us limiting. Various modifications and changes may be made to the subject matter described herein without following the example embodiments and applications illustrated and described, and without departing from the true spirit and scope of the embodiments of the concepts and technologies disclosed herein. Although various embodiments have been described as having particular features and/or combinations of components, other embodiments are possible having a combination of any features and/or components from any of embodiments as discussed above.

The invention claimed is:

1. A detachable control handle of an extended lift system configured for secure attachment with an interface of a portable grip device having a primary axis, the interface including a pair of spaced apart opposing connector tabs oriented parallel with the primary axis and extending from a rigid frame of the portable grip device, each connector tab having an offset retention surface on an inboard side forming a parallel captivation channel having a channel width, P1, in a direction perpendicular to the primary axis, each connector tab defining a connection opening extending between the inboard and outboard side, wherein the interface is configured to form a captive connector attachment with the detachable control handle, the detachable control handle comprising:

an elongate grip handle oriented parallel with the primary axis when attached to the portable grip device;

a pair of opposed support arms each having a first end portion connected to the elongate grip handle at opposite side portions of the handle, the pair of opposed support arms oriented apart from each other extending from the first end portion to an opposite second end portion and oriented parallel with the primary axis, each of the support arms having greater flexibility for bending in a direction perpendicular to the primary axis;

a pair of engagement members each attached to the end portion of a corresponding one of the pair of opposed support arms and oriented parallel with the primary axis;

a pair of opposing connector pins each having a pin length, P2, measuring the same or less than the channel width, P1, and each partially extending through an engagement member attached to a second end portion of one of the pair of support arms and oriented perpendicular to the primary axis; and a crossarm extending between the pair of support arms in a direction perpendicular to the primary axis, the crossarm establishing a preset inboard spacing between the pair of support arms at a crossarm interface proximate the second end portions of the pair of support arms including establishing the spacing for the pair of opposing pins and the pair of engagement members;

wherein:

the pair of engagement members are configured to flex inboard generally in a direction normal to the primary axis when manually flexed for overcoming an interference and enabling connection of the pair of opposing pins with the corresponding tab connectors.

2. The detachable control handle of claim 1, wherein:

a space between the pair of support arms decreases along the pair of support arms extending from the crossarm interface to the elongate grip handle;

the crossarm interface is located at a first distance from the elongate grip handle and at a second distance from the pair of opposing pins, the first distance greater than the second distance; and the detachable control handle is configured to exert outboard retention forces to the pair of opposing connector pins when attached to the portable grip device under load conditions.

3. The detachable grip device of claim 2, wherein:

a moment arm corresponding with the first distance for each of the pair of opposing support arms is three (3) to five (5) times greater than a moment arm corresponding with the second distance for each of the pair of opposing support arms; and an outboard captivation force applied to each of the pins includes an amplified force corresponding to a factor of three (3) to five (5) times a horizontal component of the corresponding reaction force at the elongate grip handle.

4. The detachable control handle of claim 3, wherein:

the moment arm corresponding with the first distance for each of the pair of opposing support arms is about four (4) times greater than the moment arm corresponding with the second distance for each of the pair of opposing support arms; and the outboard captivation force applied to each of the pins is about four (4) times the horizontal component of the corresponding reaction force at the elongate grip handle.

5. The detachable control handle of claim 1, wherein:

the pin length, P2, is about the same as the channel width, P1;

a user-applied inboard flex for at least one of the engagement members in an inboard direction rotates each of the corresponding pins by an offset angle, A, to a rotation offset from perpendicular with respect to the primary axis; and each of the corresponding rotated pins are configured to overcome, after rotation by the offset angle, an interference encountered for engaging the transverse opening of one of the pair of opposing connectors.

6. The detachable control handle of claim 5, wherein a ratio of P2 to P1 is 95% to 98%.

7. The detachable control handle of claim 5, wherein the offset angle, A, is an offset angle of three (3) degrees to ten (10) degrees.

8. The detachable control handle of claim 7, wherein the offset angle, A, is an offset angle of about five (5) degrees.

9. The detachable control handle of claim 1, wherein:

the pair of spaced apart opposing connector tabs are a first pair of spaced apart opposing connector tabs;

the pair of opposing connector pins are a first pair of opposing connector pin; and the interface of the portable grip device further comprises a second pair of spaced apart opposing connector tabs oriented parallel with the primary axis and extending from a rigid frame of the portable grip device, each connector tab of the second pair of connector tabs having an offset retention surface on an inboard side forming a parallel captivation channel having a channel width, P1, in a direction perpendicular to the primary axis, each connector tab defining a connection opening extending between the inboard and outboard side;

the detachable control handle further comprising:

a second pair of opposing connector pins having a pin length, P2, less than the channel width, P1, each partially extending through a corresponding one of the engagement members and oriented perpendicular to the primary axis.

10. The detachable control handle of claim 9, wherein:

each one of the pair of engagement members have a length extending parallel with the primary axis from a first end portion to an opposite second end portion;

one pin of the first pair of opposing connector pins extends through each one of the pair of engagement members at the corresponding first end portion;

one pin of the second pair of opposing connector pins extends through each one of the pair of engagement members at the correspond second end portion;

the pair of engagement members oppose each other;

the first and second pair of opposing connector pins are spaced apart from each other along the length of the corresponding engagement member; and each of the engagement members is attached to the corresponding support arm second end portion along the length of the engagement member between the first and second pair of opposing pins;

the elongate grip handle connects with each one of the pins through the support arms and engagement members and is configured to impart control movement forces to each of the pins and portable grip device when attached such that:

a first control moment arm is formed between the elongate grip handle and the first pair of pins;

a second control moment arm is formed between the elongate grip handle and the second pair of pins;

a third control moment arm is formed between the elongate grip handle and corresponding ones of the first pair of pins and the second pair of pins extending through the first engagement member;

a fourth control moment arm is formed between the elongate grip handle and corresponding ones of the first pair of pins and the second pair of pins extending through the second engagement member;

the first and second control moment arms are configured to impart control moments from the elongate grip handle about a rotation of axis perpendicular to the primary axis; and the third and fourth control member arms are configured to impart control moments from the elongate grip handle about a rotation axis parallel to the primary axis.

11. The detachable control handle of claim 10, wherein the first, second, third and fourth moment arms are greater than control moment arms for the portable grip device without attachment of the detachable control handle, such that the detachable control handle amplifies control forces applied by the user and imparted to the portable grip device.

12. The detachable control handle of claim 11, wherein:

the pair of engagement members is attached to the corresponding support arm second end portion along the engagement member length at an offset interface location;

the offset interface location at a first interface distance from a corresponding one of the first pair of pins is along the length of each engagement member;

the offset interface location at a second interface distance from a corresponding one of the second pair of pins along the length of each engagement member;

the first interface distance being greater than the second interface distance;

the first control moment arm is greater than the second control moment arm; and control forces applied by the user along the first control moment arm are further amplified.

13. The detachable control handle of claim 12, wherein:

the elongate grip handle is configured for gripping by a single hand of a user for aligning the user's grip along the longitudinal axis of the elongate grip handle with the primary axis of the portable grip device;

the portable grip device has a vacuum release disposed proximate the second pair of opposed pins when the detachable control handle is attached;

control forces applied by the user for releasing vacuum impart rotation in a perpendicular direction to the primary axis along the first moment arm; and the control forces applied for releasing vacuum are amplified for imparting rotation in the perpendicular direction to the primary axis.

14. The detachable control handle of claim 1, wherein:

the elongate grip handle is configured for gripping by a single hand of a user for aligning the user's grip along the longitudinal axis of the elongate grip handle with the primary axis of the portable grip device;

the detachable control handle is configured for enabling use and control of the portable grip device by a user without bending over or reducing back bend while lifting objects attached to the gripper;

the pair of opposed support arms extend downward from the elongate grip handle to the second end portions, and the elongate grip handle is disposed at a vertical height above the portable grip device when attached;

the detachable control handle further comprising:

a controller attached to the elongate grip handle and arranged for user access while gripping the elongate grip handle, the controller comprising:

an actuator attached to the elongate control handle;

an actuation cable attached to the actuator at a first end, the actuator cable extending from the first end to an opposite second end, the second end attached to a second end portion of one of the pair of opposed support arms; and a movable engagement member attached to a second end portion of one of the pair of opposed support arms and connected to the second end of the actuation cable, the movable engagement member configured and arranged for engaging an engageable control device of the portable grip device when attached;

wherein the engageable control device includes at least one of a power switch, a pump actuator, and a vacuum release.

15. The detachable control handle of claim 14, wherein:

the actuator includes a lever disposed below the elongate grip handle, the lever configured for rotation when actuated by one or more fingers of the user squeezing the lever while gripping the elongate grip handle;

rotation of the lever moves the attached cable;

the crossarm rotatably engages each of the pair of support arms permitting at least limited rotation about a longitudinal axis of the crossarm;

the movable engagement member includes a contact arm extending from the rotatable crossarm having a contact tip for engaging the engageable control device, the crossarm connected with the second end of the cable and configured to rotate when the cable is moved, the contact arm rotating with rotation of the crossarm moving the contact tip into engagement with the engageable control device when the portable grip device is attached.

16. The detachable control handle of claim 15, wherein:

the portable grip device includes a vacuum release at first end portion proximate the pair of opposing pins, the vacuum release having an engageable release button located at a top portion of the portable grip device at the first end portion, the engageable release button breaking vacuum of the portable grip device when pressed downward;

the detachable control handle amplifying control forces applied at the elongate control grip for control forces imparted to the portable grip device;

the detachable control handle further amplifying control forces applied for breaking vacuum along with use of the vacuum release including rearward rotation of the portable grip device about an axis perpendicular to the primary axis;

the lever disposed below the elongate grip handle and arranged for rotation upward about an axis at a front portion of the elongate grip handle;

upward rotation by the lever imparts rotation of the control arm and control tip for engaging the vacuum release; and the detachable control handle is configured for enhancing vacuum release via a combination of features including force amplification for control movements corresponding with vacuum release, intuitive rotation of the level upward by the user concurrent with rearward control movements for assisting vacuum breakage, and actuation of the vacuum release.

* * * * *